US005354345A

United States Patent [19]

Nehls, Jr.

[11] Patent Number: 5,354,345

[45] Date of Patent: Oct. 11, 1994

[54] REACTOR ARRANGEMENT FOR USE IN BENEFICIATING CARBONACEOUS SOLIDS; AND PROCESS

[75] Inventor: George R. Nehls, Jr., Duluth, Minn.

[73] Assignee: Minnesota Power and Light, Duluth, Minn.

[21] Appl. No.: 20,167

[22] Filed: Feb. 22, 1993

Related U.S. Application Data

[63] Continuation of Ser. No. 573,889, Aug. 27, 1990, abandoned, which is a continuation-in-part of Ser. No. 400,276, Aug. 29, 1989, abandoned.

[51] Int. Cl.[5] ..... C10L 9/08

[52] U.S. Cl. ..... 44/626; 44/629; 48/197 A

[58] Field of Search ..... 44/629, 626, 505; 48/197 A; 201/32

[56] References Cited

U.S. PATENT DOCUMENTS

| | | | |
|---|---|---|---|
| 1,632,829 | 6/1927 | Fleissner | 34/15 |
| 1,679,078 | 7/1928 | Fleissner | 34/15 |
| 1,965,513 | 7/1934 | Ruzicka | 34/24 |
| 2,610,115 | 9/1952 | Lykken | 44/572 |
| 2,668,099 | 2/1954 | Cederquist | 44/492 |
| 2,966,400 | 12/1960 | Lykken | 44/502 |
| 3,552,031 | 1/1971 | Evans et al. | 34/9 |
| 3,729,105 | 4/1973 | Huebler et al. | 214/17 B |
| 3,992,784 | 11/1976 | Verschuur et al. | 34/12 |
| 4,014,104 | 3/1977 | Murphy | 34/9 |
| 4,022,665 | 5/1977 | Ghosh et al. | 48/197 A |
| 4,052,168 | 10/1977 | Koppelman | 44/608 |
| 4,080,176 | 3/1978 | Verschuur | 44/574 |
| 4,126,519 | 11/1978 | Murray | 201/32 |
| 4,127,391 | 11/1978 | Koppelman | 44/282 |
| 4,129,420 | 12/1978 | Koppelman | 44/500 |
| 4,170,456 | 10/1979 | Smith | 44/607 |
| 4,192,650 | 3/1980 | Seitzer | 44/608 |
| 4,247,240 | 1/1981 | Schora, Jr. | 44/218 |
| 4,259,083 | 3/1981 | Ignasiak | 44/607 |
| 4,329,156 | 3/1982 | Othmer | 204/17 |
| 4,400,176 | 8/1983 | Kutta | 44/626 |
| 4,486,959 | 12/1984 | Chang | 34/9 |
| 4,579,562 | 4/1986 | Tarman et al. | 48/197 A |
| 4,701,266 | 10/1987 | Janka et al. | 210/803 |
| 4,705,533 | 11/1987 | Simmons | 44/281 |
| 4,726,810 | 2/1988 | Ignasiak | 44/282 |

OTHER PUBLICATIONS

Clean Coal Technology Round #3, Public Abstracts of Project Proposals Submitted to the U.S. Department of Energy, Aug. 30, 1989.

*Primary Examiner*—Margaret Medley

*Attorney, Agent, or Firm*—Merchant, Gould, Smith, Edell, Welter & Schmidt

[57] ABSTRACT

A process for thermochemical beneficiation of carbonaceous solids including a fraction of particles of a size less than ¼ inch across is provided. The process includes steps of providing a reactor vessel including therein a retaining structure operably positioned to separate a portion of carbonaceous solids from a wall of the reactor vessel, with a free standing liquids region therebetween. The process includes providing a portion of carbonaceous solids piled above an uppermost liquid level of process liquid within the reactor vessel. The disclosure also provides a preferred reactor arrangement for conduct of the process.

14 Claims, 12 Drawing Sheets

REACTOR ARRANGEMENT FOR USE IN BENEFICIATING CARBONACEOUS SOLIDS; AND PROCESS

The present application is a file wrapper continuation of application Ser. No. 07/573,889, filed Aug. 27, 1990 now abandoned. Application Ser. No. 07/573,889 was a continuation-in-part of application Ser. No. 07/400,276 filed Aug. 29, 1989. Application Ser. No. 07/400,276 has been abandoned.

FIELD OF THE INVENTION

The present invention relates to an improved method and system for the beneficiation of carbonaceous materials. In particular, the invention concerns processes and systems whereby carbonaceous solids, such as low rank coals and biomass, are treated so as to upgrade heating value, reduce moisture content, and improve handling characteristics.

BACKGROUND OF THE INVENTION

Carbonaceous materials such as low rank coals and biomass, e.g., peat and cattails, may be used as a substitute source of energy for high grade coals. They often contain less sulfur than many of the deposits of high rank coals and are generally more readily obtainable. These materials, however, generally contain more water and provide less energy (per unit weight) than do high rank coals.

Low rank or low grade carbonaceous materials or coals include lignite, brown coal, and subbituminous coal. Such carbonaceous low grade coals are characterized in that they have not undergone sufficient geological metamorphosis to be converted into high grade hard coals such as bituminous or anthracite.

Coal is a naturally occurring solid material that is an aggregate of undifferentiated hydrocarbonaceous solids (at room temperature), oxygen, water, and a wide assortment of inorganic minerals. Because the properties of coal vary widely between each naturally occurring deposit, attempts have been made to define broad classifications which group coal into a more coherent structure. The four most broadly used classes of coal, in descending quality, or rank, are: anthracite, bituminous, subbituminous, and lignite. In this context, "quality" can be interpreted to mean an increasing proportion of hydrocarbonaceous, i.e., carbonaceous, material per unit amount of coal. Conversely, increasing quality can also mean a decreasing proportion of the detritus, e.g., oxygen, water, and mineral content in the coal. Because there is a great diversity between the properties of each individual coal, the broad classes of coal are often subclassified as need requires: for example, Subbituminous High Volatile A, B, or C. Generally though, if a coal is to be used as a source of combustion energy, the larger the proportion of hydrocarbons per unit of coal, the better a fuel it will be.

Because the size of deposits of coal are frequently on a geologic scale, they are often referred to by their location. Another technique is to additionally refer to a coal in its relation to other sub-deposits, or seams, within the overall deposit. A common example frequently mentioned in coal literature is Illinois Bituminous Number 6. The information contained within this identity is that the coal is a bituminous coal, it is located in Illinois (USA), and it is from the sixth seam. This specifies a very particular type of coal, with relatively well documented properties. Apparently, the reason for this nomenclature system lies in the ultimately singular properties of each coal deposit.

Generally, the wider the geographic area described, the more general, or broadly, the characteristics of the coal type would be interpreted. For example, a relatively large coal deposit stretches north across the states of Wyoming and Montana. This is often referred to as the Powder River Basin deposit. Although it is understood that each specific deposit within the area will have its own individual characteristics, a Powder River Basin coal generally describes a subbituminous coal with relatively low sulfur content and relatively high moisture content. Referring to a specific coal seam within the Powder River Basin, such as Rosebud, defines a coal with the general characteristics of a Powder River Basin coal, but differing somewhat in specifics. In this case, Rosebud coal has a somewhat higher sulfur content and a mineral content specific to the Rosebud seam within the Powder River Basin.

Another similar example of common coal nomenclature can be found in North American lignites. Large deposits of lignitic coal occur in both North Dakota and Texas. As expected, these are often referred to as North Dakota lignite and Texas lignite, to specify their general properties from the even broader classification of being a lignitic coal. Referring to a specific deposit within these major deposits, such as a Center, North Dakota lignite, defines the coal even further.

There are classification systems that provide a further characterization of these materials in various ways. For example, carbonaceous materials may be classified according to their heating value. High rank coals are generally considered to be those coals that possess a heating value of greater than about 10,000 BTUs/pound, whereas the heating value of low rank coals is generally less than this value. For example, the heating value, or the "power" per unit weight, of bituminous coals is around 11,000 BTUs/pound and that of lignite is around 7,000 BTUs/pound.

Low rank coals often contain about 30% to 70% by weight moisture ($H_2O$) as mined. They also often contain up to about 20% by weight oxygen, excluding the amount contained in the $H_2O$. This oxygen is generally contained in nondecomposed organic detritus, and is typically in the form of carboxyl (—COOH) groups present in residual acids, such as humic acids, as well as sodium carboxylate (—COONa) and perhaps other metal carboxylates (—COOM), that may be present. That is, the oxygen content found in most low rank coals and peat (exclusive of that within the 30% to 70% moisture) results from the partial decomposition of products of organic matter. Biomass often contains an even higher moisture and oxygen content. Both water and oxygen are generally undesirable, at least in part because they represent weighty impurities. Furthermore, the oxygen content present in the —COOH and —COONa groups can make the material relatively reactive, which is not always desirable.

Because deposits of low rank coals and biomass are relatively vast, are sometimes less expensive to mine, and generally have relatively low sulfur contents, there is a need to render these materials more useful and efficient as fuels. This can be done, in part, by reducing the moisture and oxygen content of the mined or collected material (raw). A reduction in the sodium content also tends to improve certain handling characteristics of the material. It is also important to reduce the moisture and oxygen content of these materials in order to reduce the costs associated with transportation. For example, the relatively weighty impurities can readily result in the expenditure of millions of extra dollars in transportation costs.

Although some of the moisture content is present as surface water, which can generally be readily removed, a large portion of the water is inherent water. That is, either through chemical or physical forces the water is bound or trapped within the carbonaceous material in a manner such that it cannot be readily removed by simple physical manipulations such as filtering, decanting, or draining.

There are known methods for removal of the surface and inherent water from carbonaceous materials, such as low rank coals and biomass. Among them are processes that involve air drying. Processes known for partial or complete drying of the moist lignitic-type coal by air drying, however, generally result in a dried coal that readily crumbles or disintegrates into fine-sized particles and dust. This fine dust generally poses problems in storage and during shipment, at least in part due to their propensity for spontaneous combustion. Furthermore, the drying processes are inefficient because they generally result in consumption of large amounts of energy due to the evaporation process involved.

There are also methods known that utilize steam treatment and hot water treatment for the removal of inherent water from these materials. It is known that at temperatures generally in the range of 230° C. to 330° C., application of these methods to coal generally causes permanent loss of chemically and/or physically bound or trapped inherent water. Further, the surface of the coal is modified to a more hydrophobic state that reduces the tendency for water to adhere. Surface moisture associated with pores or capillaries is generally reduced as well. Furthermore, application of pressure exceeding the vapor pressure of water at elevated temperatures (during these processes) inhibits evaporation of the freed water. This generally is advantageous because the costs of dewatering, due to the extensive energy requirements for evaporation processes, are reduced.

Some of the known hot water or steam treatment processes involve the use of batch autoclaves at elevated temperatures with pressures greater than the vapor pressure of water at such temperatures. Other systems use rotary preheating and processing kilns.

There are also systems that use a pressurized reactor which allow for extraction of undesired inherent water and excess oxygen from low rank carbonaceous solids by the countercurrent flow of a processing liquid, e.g., water, and the solids. See, for example, P. B. Tarman et al. in U.S. Pat. No. 4,579,562. Generally, this system is used for lump size coal, that is, coal with a particle size of greater than about ¼ inch (6 mm).

Hydraulic lockhopper arrangements are known and used for both feeding coal into, and discharging beneficiated coal from, such systems. These allow for the transfer of the material between ambient pressure and the reactor pressure. In certain reactor systems the feeding and discharging systems also incorporate means for draining or dewatering the coal.

Generally, for the dewatering of relatively fine particle size coal or biomass, pumpable slurry systems are used. The relatively fine solid particles, i.e., with a particle size of less than about ¼ inch (6 mm), are entrained in a water-based slurry, which can be pressurized. The slurry is then passed through a heat exchanger for treatment. In certain systems pressurized oxygen or oxygen-containing gases are introduced to enhance the oxidation of organic matter therein. This serves as a source of heat for the dewatering process.

There are also systems known that use chemical additives during the thermal treatment of carbonaceous materials. For example, nonaqueous volatile solvents have been added to moist particulate carbonaceous material to displace the water. The addition of organic and inorganic acids has been shown to improve the process of reducing the inherent water content of coal. Other systems dry high moisture content carbonaceous solids by treating the material with hydrocarbons such as naphtha, fuel oil, low grade petroleum fractions, tar, or the like. This is done for a variety of reasons such as, for example, agglomeration of solid particles under turbulent conditions.

Certain of these systems are limited in the minimum particle size and density of the material that can be processed. Very small particles often create problems associated with, for example, plugging of certain systems. Also, materials close in density to that of water limit certain beneficiating systems to the use of less dense organic liquids, particularly in countercurrent extraction systems.

Further, certain of the beneficiating systems, and particularly the countercurrent extraction systems, use extraneous processing steps and large volumes of water that reduce the efficiency of the process and increase the costs associated with the processing. It would be generally desirable to reduce the amount of water that is needed for conservation purposes, to reduce the amount of waste water that is treated, and to more efficiently utilize energy resources.

What is needed is a more efficient beneficiation method that improves the fuel properties of a wide variety of carbonaceous solids, such as low rank coals and biomass. What is particularly needed is a system which is well adapted to handle not only solids comprising large particles, but also those solids containing materials of relatively low density and relatively small particle size. Specifically, a method is needed that more efficiently reduces the moisture, oxygen, and sodium content of carbonaceous materials, thereby upgrading the heating value of the material while improving the mechanical handling and combustion properties of the solids. Such improvements could at least in part lie in an achieved reduction in the amount of resources required to operate the process. These resources may include, but are not limited to, water, energy, and financial resources.

SUMMARY OF THE INVENTION

The methods and systems of the present invention utilize a thermochemical process of hydrothermal reforming, also known as wet carbonization or hot-water drying, for beneficiating, i.e., treating so as to improve the useful properties of, carbonaceous solids. The hydrothermal reforming process can be characterized in that it may be used to: reduce the surface and inherent water content of the solids (typically) by up to about 30%; and reduce the oxygen content by typically up to about 30%, and possibly by up to about 50%. The reduction in the water and oxygen content of the carbonaceous material, for example, results in chemical upgrading, improvement in the heating value, and improvement in the handling characteristics of the solids material. In particular, the carbonaceous material is physically reformed to a state that is permanently less retentive of water. Additionally, the preferred process results in a reduction of the sodium content of the carbonaceous material typically by about 75% to 90%, depending upon the material and the peak processing temperature. In the past, the natural sodium content of carbonaceous solids, which may be almost negligible for some low rank coals, but which is typically within the range of about 1% to 1.5% by weight for certain coals, has caused some problems in the combustion of such materials due at least in part to ash fouling. Thus, reduction in sodium content is advantageous for certain low rank coals.

It is generally believed that during a hydrothermal reforming process carboxylic —COOH (carboxyl) and —COONa (sodium carboxylate) groups break down and release carbon dioxide gas. The carbon dioxide ($CO_2$) gas, it is believed, forces liquid water out of interior pores and orifices in the material, where such water may have been trapped. The process is further believed to result in a reduction in the size of these internal pores and orifices, which may contribute to the observation that the water is not generally reabsorbed by the treated solids, even if the solids are kept immersed in water and under relatively high pressure (at approximately 2300 psi, i.e., 156 atm). Furthermore, reduction in the number of carboxyl groups may be a contributing factor to the observation that the sodium content is reduced.

Applications of the systems and methods of the present invention also preferably include oil agglomeration and low temperature drying in conjunction with hydrothermal reforming. Such processes transform, for example, low rank coals, such as subbituminous and lignite, from marginal quality fuels to higher quality, reduced sulfur, fuels. Although the sulfur content of materials such as low rank coals is normally relatively low (about 0.5% to 2%) to start with, the overall process described herein that includes both hydrothermal reforming and oil agglomeration generally results in a reduced sulfur content to advantage. Furthermore, the additional processing steps described, beyond the hydrothermal reforming process itself, can further reduce the water content of the solids by up to about 80% total. The net result is an economical fuel with improved heating value, desirable combustion characteristics, and improved transportation quality.

A process and apparatus for the thermochemical beneficiation of carbonaceous solids is described by P. B. Tarman et al. in U.S. Pat. No. 4,579,562, the disclosure of which is incorporated herein by reference. This system uses a pressurized countercurrent extraction reactor. The process introduces carbonaceous solids, between about ¼ inch (6 mm) to 4 inches (10 cm) in diameter, and substantially free of surface liquids into the upper portion of the reactor. These solids move in a countercurrent flow to a process liquid that flushes the product liquid containing dissolved and suspended organic material, which is released from the carbonaceous solids. The beneficiated solids are then removed from the lower portion of the reactor. The product liquid is removed from the upper portion of the reactor and is directed to a water treatment facility.

The systems and methods of beneficiating carbonaceous solids according to the present invention utilize a unique and improved reactor arrangement for hydrothermal reforming, with a reactor vessel adapted to confine a downwardly moving bed of carbonaceous solids and a countercurrent flow of process liquid. The reactor vessel of the present invention, because of certain improvements discussed in detail below, can advantageously be used to beneficiate a wide variety of low rank coals and other carbonaceous solids. For example, carbonaceous solids including a substantial fraction of material with a particle size of less than about ¼ inch (6 mm), as well as solids including a substantial fraction with a particle size of up to about 4 inches (10 cm), are relatively efficiently and/or effectively beneficiated using the preferred systems and methods of the present invention. Typically, a carbonaceous material with at least about 5% to 10% of a fraction with a particle size of less than about ¼ inch, and more typically with at least about 50% with a particle size of less than about ¼ inch can be advantageously beneficiated using the preferred systems and methods of the present invention. Similarly, a carbonaceous material with at least about 5% to 10% of a fraction with a particle size of up to about 4 inches, and more typically with at least about 50% with a particle size of up to about 4 inches can be advantageously beneficiated using the preferred systems and methods of the present invention. The reactor arrangement of the present invention possesses many other improvements and advantages over known systems, as will become apparent in the following discussions.

Within a preferred reactor vessel of the reactor arrangement according to the present invention, is a lower countercurrent reactor region, a freestanding liquid region and means for defining each. The freestanding liquid region is located generally above the lower countercurrent reactor region and is in fluid flow communication therewith. Also, within a preferred reactor vessel there is a retained solids region, and means for defining such, oriented above the lower countercurrent reactor region and in solids flow communication therewith. Each of the retained solids region and the freestanding liquid region provides advantages to the operation of the reactor vessel. When in combination in a preferred embodiment additional advantages are realized. Certain of these advantages will become apparent through the following discussions.

In the preferred embodiment containing both a retained solids region and a freestanding liquid region, the retained solids region is separated from the freestanding liquid region by suitable means (although in some applications direct fluid flow therebetween is permissible). The retained solids region is preferably defined, at least in part, by a retaining structure, which in a preferred embodiment has a somewhat annular configuration such as a ring or funnel shape, of which at least a portion defines an internal volume and has an external surface. The external surface of the retaining structure, in a preferred embodiment, completely circumscribes the internal retaining volume, and thus the retained solids region, and in part defines the freestanding liquid region. The freestanding liquid preferably circumscribes at least a portion of the external surface of the retaining structure. In other words, during operation the freestanding liquid region circumscribes at least a portion of the carbonaceous solids retained by said structure. More preferably, the freestanding liquid region completely circumscribes a portion of the external surface of the retaining structure. The retaining structure may be mounted in the reactor vessel in any of a variety of manners. For example, the retaining structure may be mounted on an internal sidewall of the reactor vessel or it may include a cylindrical or funnel (or similar) extension depending from an upper portion of the internal sidewall, or from a top wall, of the reactor vessel.

The reactor vessel advantageously and preferably incorporates a fluid flow arrangement, which includes an outlet arrangement in fluid flow communication with the freestanding liquid region. In a preferred embodiment the fluid flow arrangement also includes an inlet, for selectively providing, i.e., directing, fluid flow into the lower countercurrent reactor region. Furthermore, the fluid flow arrangement preferably includes means for directing fluid flow from the inlet arrangement through the lower countercurrent reactor region into the freestanding liquid region, and from the freestanding liquid region to the fluid flow outlet arrangement.

In preferred operation, at least a portion of the process liquid is directed into the freestanding liquid region, which circumscribes at least a portion of the carbonaceous solids. From this freestanding liquid region at least a portion of the fluid is preferably directed into the fluid flow outlet arrangement. In a preferred embodiment, at least a portion of the process liquid is then directed from the reactor fluid outlet arrangement to the reactor fluid inlet arrangement (i.e., recycled). Between the outlet and inlet arrangements, the process liquid is preferably directed through a recirculation heat exchange system. In this manner, the temperature of the process liquid can be adjusted and thus used to maintain an effective temperature in the lower countercurrent reactor region. Additionally, a secondary heat supply system may be used in a preferred embodiment for maintaining an effective temperature in the reactor.

At least a portion of the process liquid, in a preferred embodiment, is directed from the freestanding liquid region through the fluid flow outlet arrangement to feeding means for feeding carbonaceous solids, i.e., a solids feed system, which charges the reactor with the carbonaceous solids and is further discussed below. By such a preferred arrangement, the process liquid both pressurizes the system and heats the solid material somewhat before it is charged into the reactor. That is, in a preferred embodiment, the system of the present invention utilizes a method whereby process liquid is extracted from the upper countercurrent reactor region and is directed to the solids feed system. Because the extracted process liquid is used to charge the solids feed system, preferred systems and methods reduce the amount of extraneous liquid introduced into the process.

For processes according to the present invention there is no requirement that all surface or other extraneous liquid be removed from the carbonaceous solids before charging the reactor vessel. In conventional systems, which use an external source of liquid to charge the solids feed system, i.e., liquid that has not been recycled from the reactor vessel, the removal of the surface liquid from the carbonaceous solids before feeding into the reactor vessel is preferable so as to not adversely affect the process. That is, superfluous amounts of liquid act as diluent and may adversely affect the thermodynamics of the process. Therefore, in conventional systems, extraneous amounts of liquid (in the solids feed) are removed by using a dewatering apparatus such as a screw conveyor. Since a dewatering system is not needed by the preferred embodiment of the system and method of the present invention, a more efficient and less complicated means can be used to advantage for selectively feeding carbonaceous solids on a substantially continuous basis into the retained solids region of the reactor vessel.

The solids feed system of a preferred embodiment provides means for selectively and substantially continuously feeding carbonaceous solids into the reactor, specifically into the internal volume of the retaining structure, i.e., the retained solids region, of the reactor vessel. A preferred such system includes a plurality of feed lockhoppers, e.g., hydraulic lockhoppers, for feeding the solids directly into the reactor vessel. As stated above, process liquid extracted from the upper portion of the reactor is preferably used at least in part to pressurize the feed lockhoppers.

The solids feed system of a more preferred embodiment provides a lockhopper, or series of lockhoppers, each of which is capable of intermittently feeding solids into the reactor, which is operated at a pressure of at least a first operating pressure. Each of the lockhoppers includes a storage receptacle, means for delivering feed solids into the storage receptacle at a second pressure, which is lower than the first operating pressure, and means for delivering feed solids from the storage receptacle into the reactor at an operating pressure thereof. It is to be understood that the pressure of the reactor vessel can vary from that of the first operating pressure, and that typically this second pressure is atmospheric pressure. Each of the lockhoppers also includes means for venting gas from the storage receptacle and means for pressurizing the storage receptacle from the second pressure at least up to the first operating pressure with liquid. In this arrangement the lockhopper is thereby designed for pressurization as a hydraulic lockhopper and depressurization as a gas-filled lockhopper.

In preferred reactor arrangements, shunt means is provided by which process gas flow is directed into a process gas receiving region, which is oriented above the freestanding liquid region. This process gas flow is preferably directed from a location in the submerged solids portion of the downwardly moving bed of carbonaceous solids in the lower countercurrent reactor region, which may generally be divided into a solids preheat zone, a hydrothermal reaction zone, and a liquid preheat zone (i.e., an upper, middle, and lower portion). The preferred shunt means includes at least one gas flow tube having a first end oriented in the process gas receiving region, and a second end, preferably with means to inhibit transfer of larger particles therethrough, oriented in the lower countercurrent reactor region. In a preferred embodiment, the second end is oriented in the portion of the lower countercurrent reactor somewhat above the region in which the solids are beneficiated, i.e., above the hydrothermal reforming reaction zone, in the solids preheat zone. The gas flow tube allows at least some of the process gases to be diverted directly into the process gas receiving region. By this it is meant that some of the process gases are funneled, i.e., shunted, out of the lower reactor region through a tube. In this way the process gases are less likely to disturb the countercurrent flow of process liquid and carbonaceous solids. The diverted process gases are then preferably discharged from the process gas receiving region through outlet means, e.g., a vent arrangement. The process gases may then be directed to the feed lockhoppers or the solids discharging system, if desired, for advantageous operation of these systems.

The preferred reactor arrangement also includes means whereby the carbonaceous solids are selectively and substantially continuously discharged from the downwardly moving bed of carbonaceous solids using conveying means for transferring the solids under pressure from the reactor vessel. The discharge of the carbonaceous solids is preferably from the lower portion of the lower countercurrent reactor region. This improved method facilitates withdrawal of the beneficiated carbonaceous solids during the beneficiating process, and can significantly reduce chance of process failure by plugging.

Several embodiments of this conveying means or solids discharge arrangement are described in detail. For example, the conveying means may include at least one screw conveyor. The screw conveyor(s) may be sufficiently long and narrow in cross section to allow direct discharge of the carbonaceous solids to ambient pressure. The conveying means may also include a hollow-shafted auger(s) for providing advantageous discharge of the beneficiated solids. In a preferred embodiment, the screw conveyor(s) discharges the solids into a hydraulic lockhopper while under pressure. For added advantage a plurality of hydraulic lockhoppers are used for substantially continuous discharge.

The drawings constitute a part of this specification and include exemplary embodiments of the present invention, while illustrating various objects and features thereof. In some instances, relative dimensions may be shown exaggerated to facilitate an understanding of the invention. It will be understood that many variations from the systems shown in the drawings may be made while remaining within the spirit and scope of the invention.

DETAILED DESCRIPTION OF THE INVENTION

Figure 1:
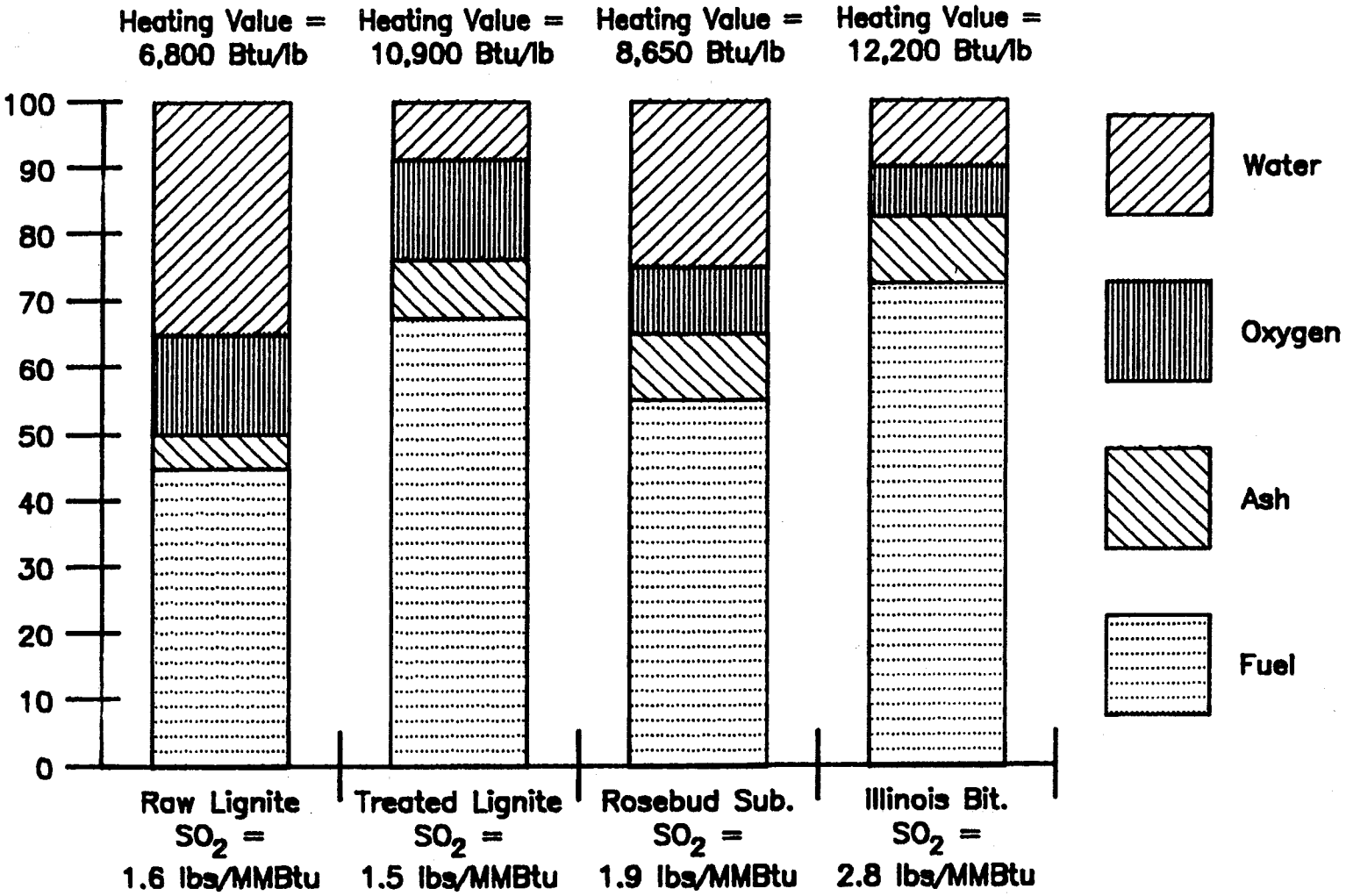
FIG. 1 is a comparison chart of compositions of selected fuels.

As required, detailed descriptions of preferred embodiments of the present invention are provided herein. In general, the detailed descriptions are to be considered as exemplary only. Therefore, the invention is not to be interpreted as limited except as defined by the claims.

Many carbonaceous materials, and particularly low rank coals, beneficiate under pressure and when in communication with hot water by the expulsion of both surface and inherent water from the carbonaceous material. Surface moisture is generally understood to be that moisture associated with the surface of a coal particle, which includes the surface associated with pores, micropores, and cracks. Inherent moisture is generally understood to be that moisture chemically bound or entrapped within the coal matrix. The expulsion of water is due, at least in part, to destruction of surface carboxyl (—COOH) and sodium carboxylate (—COONa) groups, and perhaps other metal carboxylate (—COOM) groups, releasing carbon dioxide. The carbon dioxide then forces water out of the material. The system of the present invention utilizes this thermochemical process of hydrothermal reforming for beneficiating, or improving the properties of, carbonaceous solids.

Hydrothermal reforming processes typically reduce the surface and inherent water by up to about 30%. (Further processing steps following the hydrothermal reforming process aid in reducing the water content by up to about 80% total.) Furthermore, the conversion of surface carboxyl and sodium carboxylate and/or other metal carboxylate groups to gaseous $CO_2$ contributes to the reduction in the oxygen content by typically up to about 30%, and possibly by up to about 50%. Herein, when a reference is made to reduction in oxygen content, the intent is to refer to oxygen groups in the coal (for example, carboxylate groups). No reference to oxygen in water is meant.

The reduction in the moisture and oxygen content results in, for example, the chemical upgrading of the solids, improvement in the heating value of the energy resource, and improvement in the handling characteristics of the material. Additionally, such processes result in a reduction of the sodium content to advantage. The sodium content may be reduced by up to about 75% to 90%.

An example of a carbonaceous solid that an overall process according to the present invention can be used to effectively beneficiate is North Dakota lignite. North Dakota lignite characteristically has a heating value of 6,800 BTUs/pound, contains 47% hydrocarbons (fuel), 34% moisture, 12% oxygen, and 7% ash. Note, the percentage of hydrocarbons herein refers to the percentage of carbon and hydrogen, whereas oxygen is reported as a separate percentage, i.e., the oxygen content is not included in what is referred to as hydrocarbon content. The ash is typically high in sodium content (about 2% to 10%), which can create severe boiler fouling problems. The ash is also typically high in minerals, especially silica, and is often represented simply as $SiO_2$ for purposes of mass flow analysis. The sulfur content of North Dakota lignite is normally relatively low. It generally contains about 0.8 pounds of sulfur per 1 million BTUs of fuel. When the sulfur content is represented as the combustion by-product $SO_2$, the content is represented as 1.6 pounds $SO_2$/MMBTU (MMBTU=millions of BTUs). North Dakota lignite in its raw state is also characterized by a well documented tendency to self-ignite if exposed to air for several days. Furthermore, after air drying, it has an even greater tendency to self-ignite and becomes very dusty and prone to crumbling when stored for similar time periods.

This material can be transformed by the system and method of the present invention to an economical, higher quality fuel. By comparison, the processed fuel will have a nominal heating value of 10,900 BTUs/pound, 68% hydrocarbons (fuel), 9.5% moisture, 14% oxygen, and 8.5% ash. The sodium content of the ash will have been reduced to about 1% to 2%. Such material will exhibit excellent combustion characteristics. In addition, as a result of overall processing as described herein, the sulfur content of the fuel will have been reduced to about 1.5 pounds $SO_2$/MMBTU. The processed fuel generally will exhibit little or no tendency to self-ignite, and will have substantially reduced dusting and crumbling tendencies. This is in part because of physical changes in the surface structure of the coal, generally thought to be related to the replacement of hydrophilic surfaces with hydrophobic tars. See, for example, EPRI report AP-4905, *Low Rank Coal Water Slurries for Gasification*, December 1986. A chart of the relative compositions of raw North Dakota lignite, treated (processed according to the present invention) North Dakota lignite, and two other coals (Rosebud subbituminous and Illinois bituminous) for comparison is presented in FIG. 1.

As stated above, hydrothermal reforming is believed to break down —COOH and —COONa groups, which are present in the solids, and release carbon dioxide ($CO_2$). The carbon dioxide gas is believed to play a role in removing the liberated liquid water by forcing the water out of interior pores and orifices, where it may be trapped. The sodium content is generally reduced by this process, probably due, at least in part, to reduction in the number of carboxyl groups.

A product that has gone through a hydrothermal reforming process has a permanently transformed, or reformed, structure with a reduced capacity to retain water therein. Although it is stated above that this process reduces the moisture content of typical carbonaceous solids, such as low rank coals, by typically up to about 30%, the moisture content of the coal product exiting the reactor is typically higher than the "equilibrium" moisture content of the coal product. (Equilibrium moisture is defined by ASTM standard D1412.) This is due to the fact that the coal is exiting a wet process, and is still drying towards its equilibrium moisture content. Since drying is not an instantaneous phenomena, the coal product removed from the reactor is in a transitional state. For example, a raw North Dakota lignite with an initial moisture content of about 35% will be found to have a moisture content of about 25% upon exiting the hydrothermal reforming process. The product's equilibrium moisture content, however, will typically be in the range of 8% to 13%, depending upon process peak operating temperatures.

Figure 2:
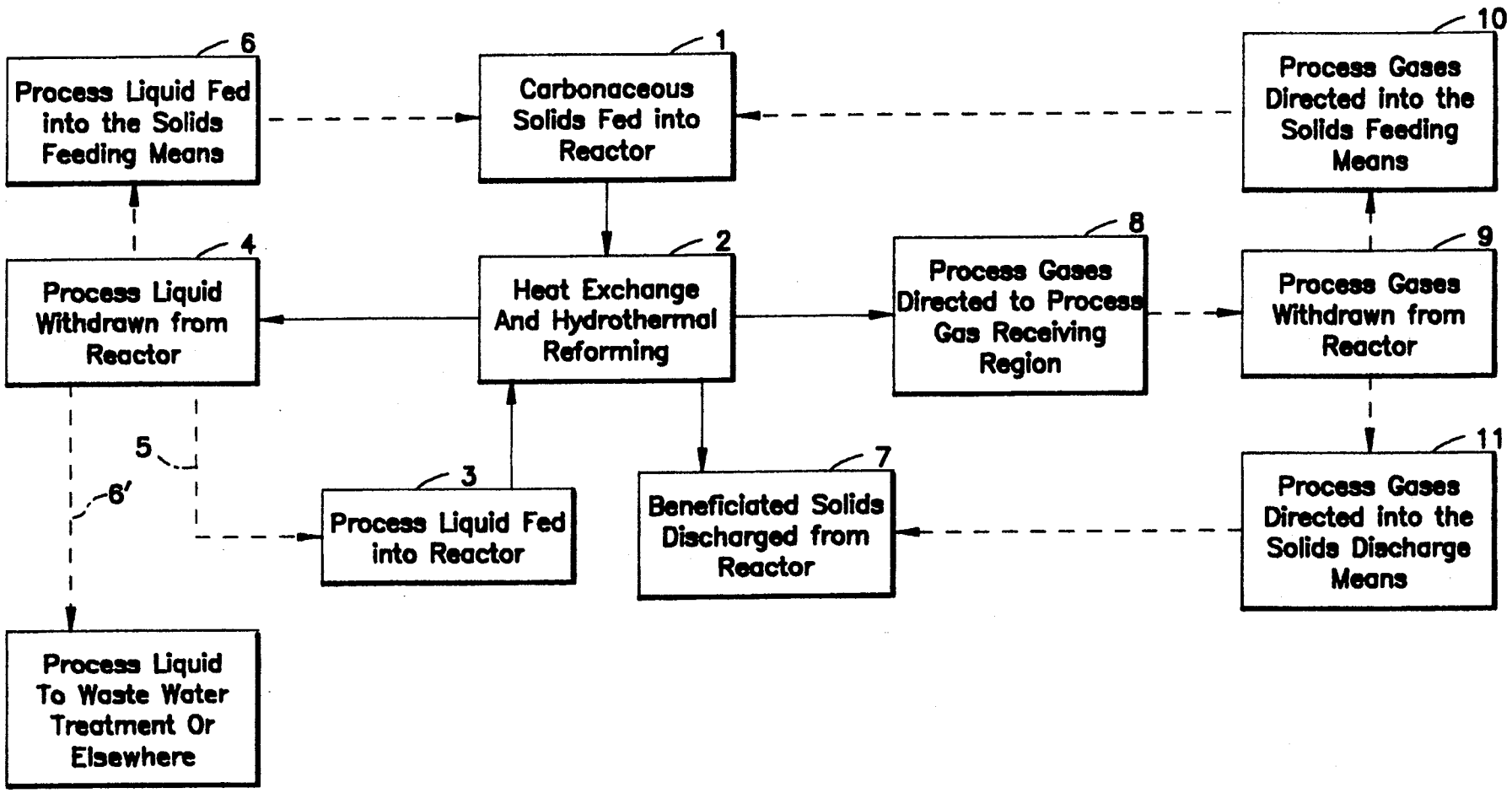
FIG. 2 is flow chart of a preferred hydrothermal reforming process involving methods according to the present invention.

A preferred system and method of beneficiating carbonaceous solids according to the present invention utilizes a hydrothermal (hot water) reforming process as outlined in the flow chart in FIG. 2. At 1, carbonaceous solids are fed into a reactor wherein, at 2, heat exchange and the hydrothermal reforming reaction occurs. The system and method involve a downwardly moving bed of carbonaceous solids and a countercurrent flow of process liquid for countercurrent extraction and energy exchange. The process liquid is fed into the reactor, at 3, below the level at which the reformation occurs, and is withdrawn from the reactor, at 4, above the level of the submerged downwardly moving bed of solids. This process liquid is preferably recycled and directed back into the reactor for further processing of solids (see path 5). At least a portion of the extracted process liquid may also be used in the process of charging, or feeding, the reactor with the solids (refer to the description at 6). In addition, liquid is extracted from the process at a rate more or less equal to the rate at which moisture is extracted from the coal. This is done to maintain an appropriate liquid level in the reactor. This extracted process liquid is directed out of the process at 6', for example, to waste water treatment.

The beneficiated carbonaceous solids are discharged from the reactor by suitable means (see reference numeral 7). Preferred ones are those capable of removing the solids from the reactor without a need for significant reduction of pressure within the reactor. Furthermore, the hydrothermal reformation process typically results in the production of gases, such as $CO_2$, which are preferably directed, or shunted (at 8), directly into a process gas receiving region of the reactor, located above the solids and liquid level. These gases may also be withdrawn from the reactor, at 9, and be optionally used in the process of feeding the solids into the reactor, at 10, or discharging the solids from the reactor, at 11, or completely withdrawn from the reactor.

Figure 3:
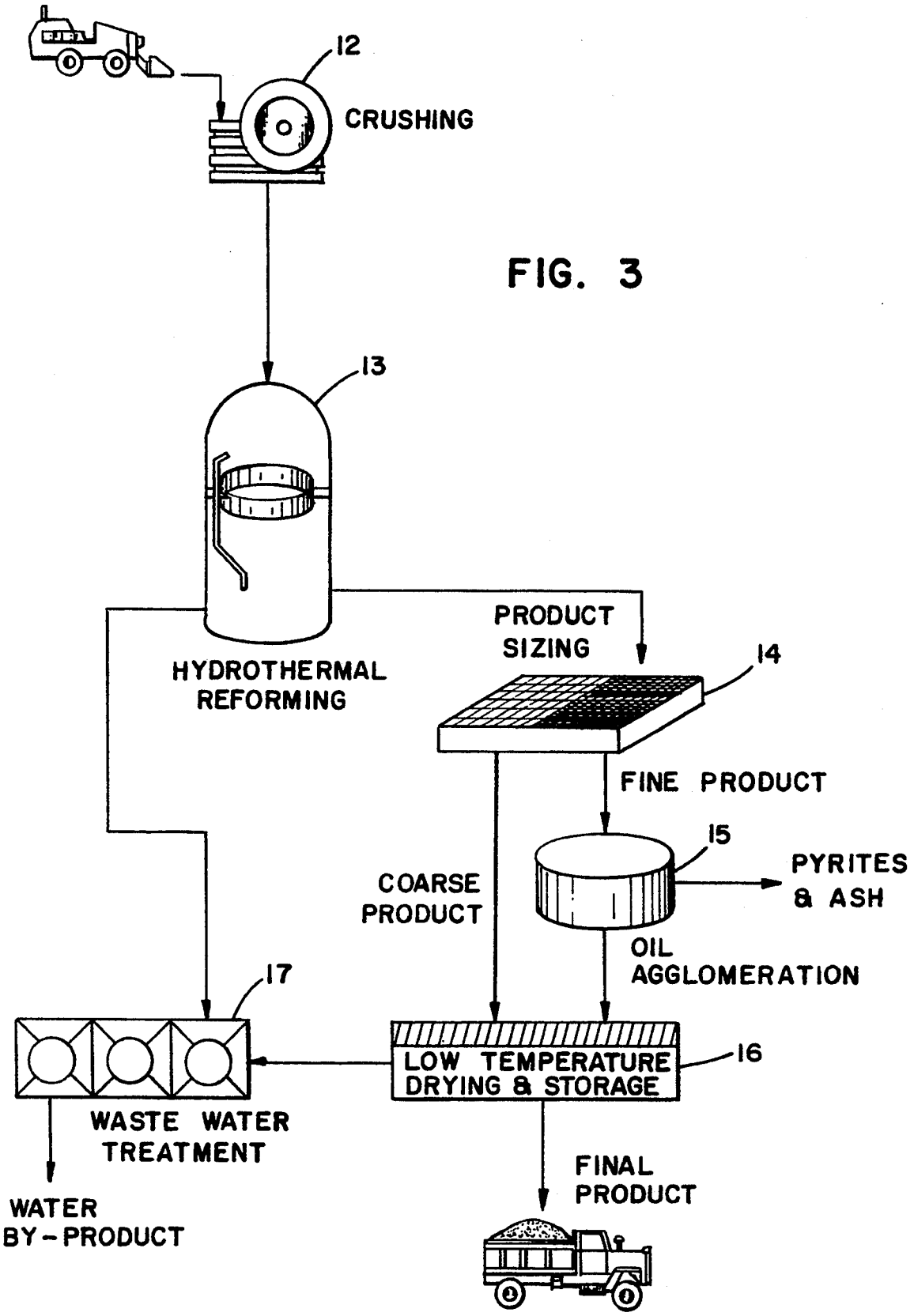
FIG. 3 is a flow chart of an overall process involving selected methods of hydrothermal reforming, oil agglomeration, and low temperature drying according to the present invention.

An overall preferred application of the beneficiation process of the present invention encompasses the hydrothermal reforming process outlined in FIG. 2, an oil agglomeration process, and low temperature drying (see FIG. 3). For example, a carbonaceous solid such as lignite is transported from the mine to a processing plant 12 where it is crushed. The crushed coal is then transported to the hydrothermal reforming vessel(s) 13, i.e., the reactor vessel(s). Following hydrothermal reforming, the beneficiated product is screened, at 14, to split the coal into two general groups according to size. That is, product sizing occurs at 14. The coarse product typically consists of particles greater than about ⅛ inch (3 mm) as the smallest dimension, and the fine product consists of particles less than about this particle size. The fines undergo selective oil agglomeration, at 15, which reduces the amount of pyrites and ash contained therein. The fine product, i.e., fine fraction, then undergoes low temperature drying, at 16. The coarse particles directly undergo low temperature drying, at 16. The final product is then stored also at 16. Also included in this process is a treatment facility 17, i.e., a waste water treatment facility, for process liquid used in the hydrothermal reforming vessel 13 and liquid removed in the drying operation at 16, and later discharged as a liquid by-product.

Selective oil agglomeration involves the mixing of relatively fine coal particles in a water-based slurry. Under high shear mixing a small portion of oil is then added to the slurry. The fine coal particles tend to agglomerate into larger particles. Detritus, such as ash and pyrites, that have become liberated, i.e., no longer adhere to the coal particles, do not then typically re-attach to the coal/oil agglomerates. It is noted that, although the portion of coal that is defined as "fines" will vary according to coal, processing conditions, and desired product, a typical proportion of fines is about 25% of the total coal mass flow that has been previously processed by hydrothermal reformation.

The conditions of the countercurrent reformation reaction process for beneficiating carbonaceous solids vary depending upon the type of material. Generally, however, the hydrothermal reforming reaction operates at a peak temperature of about 450° F. to 630° F. (230° C. to 330° C.). The pressure within the reactor used for this reaction should be sufficient to prevent vaporization of the process liquid (typically water) at these temperatures. Operating pressures used in processes and reactors of this type generally range from about 300 to about 2300 psi (about 20 to 156 atm). The desired pressure usually depends upon the density of the solids in the moving bed, and is generally maintained at about 30 to 70 psi (about 2 to 5 atm), and preferably about 45 to 55 psi (about 3 to 4 atm), above the saturation vapor pressure of the liquid at the peak temperature of the reaction.

The flow rate of the solids in the downwardly moving bed is adjusted such that a sufficient residence time is maintained to achieve effective beneficiation, i.e., reforming. This varies depending upon the type of material and the particle size of the material. Generally, for materials such as low rank coal with a maximum particle size of about 4 inches (10 cm), the flow rate necessary to accomplish effective beneficiation is such that the residence time is about 40 to 80 minutes, and preferably about 60 minutes. For materials such as biomass with a mean distance to center particle size of less than about 0.5 inch (1.27 cm), the residence time is generally about 30 minutes. The rate of the countercurrent flow of process liquid is also adjusted such that the carbonaceous solids are effectively beneficiated and the by-products of the process are effectively removed.

In conventional systems for beneficiating carbonaceous solids that utilize a countercurrent hydrothermal reforming process, certain solids are generally not readily, efficiently, and economically beneficiated. For example, for conventional systems, solids with a density that is close to that of water generally require a less dense organic liquid to produce effective countercurrent flows. Furthermore, solids fractions with a particle size less than about ¼ inch (6 mm) are generally not advantageously beneficiated, particularly when process liquid is extracted from the reactor. In these situations, a portion of the solids may become entrained in the extracted liquid, and thus require expensive or elaborate filtration or separation systems to remove the solids to reduce associated problems, such as the plugging of various portions of the processing apparatus. The present invention concerns an improved method and system to beneficiate a wide variety of solid carbonaceous materials (including those with fractions of relatively small particles) relatively efficiently and easily.

The reactor arrangement of the present invention incorporates means to relatively effectively and efficiently reduce the problems associated with beneficiating solids including materials with fractions of relatively small particle size and/or relatively low density by preferably using water as the process liquid, and by reducing the amount of entrained solids in process liquid that is extracted from the reactor arrangement. It will be understood by this representation that it is not meant that the entrainment of solids in the liquid extraction process is completely eliminated by the present invention, or that filtration systems cannot be used in addition, to advantage. Rather, the size and amount of solids that do become entrained in the extracted liquid are advantageously reduced. These improvements are accomplished, at least in part, by use of a reactor vessel with a retaining structure, as discussed below. In addition, use of such a retaining structure can be used to advantage in the control of the process operation.

Reactor Vessel with Retaining Structure

Figure 4:
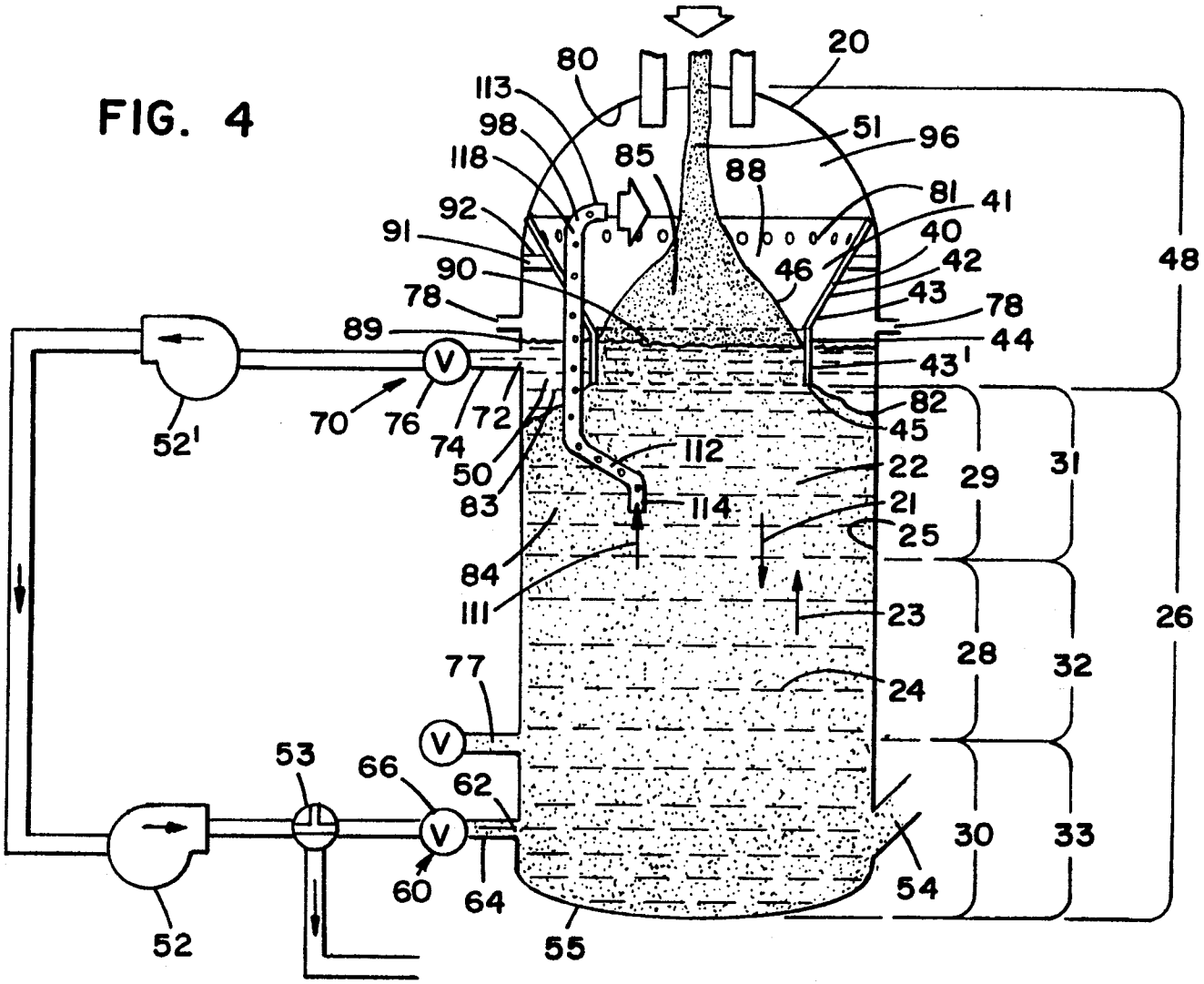
FIG. 4 is a schematic drawing of a reactor vessel (containing a funnel-shaped retaining structure patterned after a cross-sectional view) for use in application of the present invention.

FIG. 4 is a schematic of a hydrothermal reforming reactor or reactor vessel 20 of the present invention. The reactor vessel 20 may correspond to the reactor 13 in FIG. 3. The reactor vessel 20 is adapted to confine a downwardly moving (moving in the direction of arrow 21) bed of carbonaceous solids 22 and a countercurrent flow (moving in the direction of arrow 23) of process liquids 24. That is, the material to be beneficiated flows downwardly through the reactor vessel 20 as a packed bed of solids 22 countercurrent to the liquid 24, typically water, that flows upwardly through the reactor vessel 20. The reactor vessel 20 includes an internal side wall 25 for defining, at least in part, a lower countercurrent reactor volume or region 26. The lower countercurrent reactor region 26 can be viewed as including three general regions consisting of: a (central) hydrothermal reforming reaction zone 28; an (upper) solids preheat zone 29 (which is a volume of direct countercurrent heat exchange); and, a (lower) liquid preheat zone 30 (which is also a volume of direct countercurrent heat exchange). By this, it is not meant that there are three distinct and separate regions or zones with specific and rigidly defined boundaries. Rather, these regions (28, 29, and 30) are approximately defined by the upper third, middle third, and lower third portions, 31, 32, and 33, respectively, of the lower countercurrent reactor region 26. The hydrothermal reforming reaction zone 28, which is where the majority of the hydrocarbon reforming reactions typically occur, is generally in the middle portion 32. The solids preheat zone 29, which is where the temperature of the bed of carbonaceous solids 22 is generally increased so as to be within or near the temperature range at which the hydrothermal reforming reaction efficiently occurs, is in the upper portion 31 of the lower countercurrent reactor region 26. The liquid preheat zone 30, which is where the temperature of the process liquid is increased to within or near the temperature range for effective beneficiation of the solids, is in the lower portion 33 of the lower countercurrent reactor region 26. Thus, the reaction zone 28 is merely that region in which both the liquid and the solids are at an appropriate temperature for beneficiation reactions to efficiently occur.

The reactor vessel 20 further includes a retaining structure 40 defining an internal volume 41. The structure 40 of the embodiment shown includes an outer wall 42 defining: an upper extension or funnel portion 43; a lower ring 43'; an external surface 44; and, a bottom edge 45. The retaining structure 40 defines a retained solids region 46 above the lower countercurrent reactor region 26 and in solids flow communication therewith. The bottom edge 45 of the retaining structure outer wall 42 generally defines a "boundary" in the reactor 20 between the lower countercurrent reactor region 26 and an upper countercurrent reactor region 48. It is not meant, however, that there is a physical boundary or separation between the two regions 26 and 48. There is indeed fluid flow and solids flow therebetween. The distinction has been made for ease of description. The retained solids region 46 is thus located in the upper countercurrent reactor region 48 and is generally the portion of the reactor vessel 20 into which the carbonaceous solids are initially introduced. A portion of the downwardly moving bed of solids 22 is retained by the retaining structure 40 in the sense that the solids are retained, or confined, to a space of smaller cross-sectional area (i.e., a region with a smaller cross-sectional diameter if the retaining structure ring 43' is annular) than that of the reactor vessel 20. This configuration allows for a freestanding liquid region 50, i.e., a region generally free of the introduced feed solids 51.

For the embodiment shown in FIG. 4, the freestanding liquid region 50 is defined by the external retaining surface 44, at a location generally above the lower countercurrent reactor region 26 and in fluid flow communication therewith. It is noted that at least a portion of the freestanding liquid region 50 may be within what is defined as the lower countercurrent reactor region 26. The retaining structure 40 generally separates the retained solids region 46 from the freestanding liquid region 50 at least with respect to any substantial direct solids flow therebetween. The retaining structure 40 may allow direct fluid flow communication between the regions 46 and 50. That is, during operation, the retaining structure 40 generally segregates a portion of the process liquid 24 in the upper countercurrent reactor region 48 from the downwardly moving bed of carbonaceous solids 22. This creates a region 50 in which a portion of the liquid 24 will be generally free of the solids bed 22. This advantageously provides a generally solids-free liquid for extraction (and, if desired, recycling for use elsewhere in the reactor), and process control.

During operation, the bed of carbonaceous solids 22 moves downwardly countercurrent to the upwardly moving process liquid 24 in the lower countercurrent reactor region 26. The process liquid 24 may be any liquid that can be heated to the desired hydrothermal reforming temperatures which result in the effective beneficiation of the desired carbonaceous solids 22. Preferably and advantageously the process liquid 24 is water. The process liquid 24 is preferably introduced under pressure by pump means, such as pump 52 in conjunction with a valve arrangement 53 for directing process liquid to solids discharge means (which operates through opening 54 and is discussed in further detail below), into the lower portion 33 of the lower countercurrent reactor region 26 at or near a base 55 of the reactor vessel 20 through a fluid flow inlet arrangement 60, which for the embodiment shown comprises: a fluid flow inlet port 62; a fluid flow inlet conduit 64; and a fluid flow inlet control valve 66. The process liquid 24 is withdrawn from the reactor vessel 20 via a fluid flow outlet arrangement 70, which for the embodiment shown comprises: a fluid flow outlet port 72; a fluid flow outlet conduit 74; and a fluid flow outlet control valve 76. The fluid flow of the process liquid 24 is directed from the fluid flow inlet arrangement 60 through the lower countercurrent reactor region 26 into the freestanding liquid region 50 and preferably from the freestanding liquid region 50 to the fluid flow outlet arrangement 70. The rate that the process liquid 24 is introduced into the reactor vessel 20 may be controlled by the fluid flow inlet control valve 66. Also near the base 55 of the reactor is means for steam input 77 for a source of thermal energy.

For the embodiment shown in FIG. 4, means are provided to facilitate control of fluid level within reactor 20. In particular, an overflow drain orifice 78 is provided in the reactor vessel 20, and location above outlet port 72. As a result, should the liquid level surge during operation, an overflow is provided. Flow under pressure from the overflow drain orifice 78 may be directed into waste water treatment, or the like, FIG. 5. For the arrangement shown in FIG. 4, a plurality of overflow drains 78 are shown.

As indicated above, for the embodiment of FIG. 4, the retaining structure 40 defines external surface 44. Also, for the preferred embodiment shown, the external surface 44 completely circumscribes the internal retaining volume 41. Preferably, the ring portion 43' of retaining structure 40 mirrors the shape of the reaction vessel. For the embodiment shown, the ring portion 43' of retaining structure 40 has an annular or circular configuration, since the preferred reactor 20 is circular in cross-section. It is to be understood, however, that alternate configurations of the retaining structure 40 are possible. For example, the ring portion 43' of retaining structure 40 may be square-shaped in some applications. The wall 42 of the retaining structure 40 is angled upward and outward, i.e., flared, such that the upper extension 43 extends up to or near the internal top wall 80, i.e., towards the upper portion of the internal sidewall 25, of the reactor vessel 20. This inhibits spilling of solids into the freestanding liquids zone 50. Apertures 81 in the upper extension 43 allow for pressure equilibration between portions of the reactor 20.

The use of a retaining structure 40 installed within the reactor vessel 20 allows for the establishment of a retained solids region 46 of the densely packed, downwardly migrating bed of carbonaceous solids 22. As stated above, in a preferred embodiment, the retained solids region 46 is smaller in cross-sectional diameter than the reactor vessel 20. During operation, as the bed of solids 22 migrates downwardly (along the direction of arrow 21) it passes: through the retaining structure 40; out of the internal volume 41; and into the lower countercurrent reactor region 26 such that it spreads out to the internal wall 25 of the reactor vessel 20, and adopts a characteristic angle of repose 82. The angle of repose, also known as the angle of rest, can be defined as "the maximum slope at which a heap of any loose or fragmented solid material will stand without sliding, or will come to rest when poured or dumped in a pile or on a slope" (McGraw-Hill Dictionary of Scientific and Technical Terms: D. W. Lapedes, Ed.; 1974, p. 68). Solids are known to adopt a characteristic angle of repose, both when dry and when wet, depending upon the type and particle size of the solids. Thus, it is understood that region 50 is formed (above the solids angle of repose) into which the process liquid 24 may flow and be generally segregated from the downwardly moving bed of solids 22. However, it is also understood that freestanding liquid 83 in the region 50 will be in direct contact with the submerged solids 84.

While in the retained solids region 46, the downwardly moving bed of carbonaceous solids 22 herein are referred to as the retained solids 85. This is also meant to include any solids that rest upon those within the internal volume 41 and extend along the upper extension 43 of the retaining structure wall 42, or which are piled up within volume 88. Upon exiting the internal volume 41 of the retaining structure 40, the downwardly moving bed of solids 22 is herein referred to as the submerged solids 84. During operation, for the embodiment of FIG. 4, the freestanding liquid region 50 is defined by the reactor internal side wall 25, the external surface 44 of the retaining structure 40, and the submerged solids 84, which reside at their wet angle of repose 82. Herein, the process liquid 24 within the freestanding liquid region 50 is referred to as the freestanding liquid 83 with a surface or upper level 89. During operation, therefore the retained solids region 46 extends above the upper level 89 of the freestanding liquid 83 (and similarly, above the upper surface 90 of the process liquid 24 within the retaining structure 40).

The weight of the retained solids 85 provides a downward pressure on the densely packed submerged solids 84. This provides an improvement in performance over other countercurrent reactors, in which a retained solids region 46, as defined by a retaining structure 40, is not present. Generally, in conventional systems solids of relatively low density, e.g., those that are close in density to that of water, do not migrate downward readily and effectively in a countercurrent manner to the upward flow of water. Therefore, generally less dense liquids and/or relatively low flow rates are necessary to produce an effective countercurrent flow for such solids. The arrangement of the present reactor, however, permits the use of process liquids, or fluids, that are closer in density to that of the solids (or vice versa). Fine carbonaceous solids, such as biomass, therefore, can preferably use water as the working fluid rather than light, i.e., less dense, organic liquids. In addition, the allowable upward flow velocity for the process liquid 24 can be increased since the downward pressure of the retained solids 85, enhanced from the presence of solids piled above the liquid upper surface 90 within the retaining structure 40, can counteract the liquid flow. This allows for more efficient, economical, and effective beneficiation of carbonaceous materials in general, and especially for those materials with a significant percentage of relatively fine particles.

The creation of a region 50 of freestanding liquid 83, whether by a retaining structure 40 or some other means, is advantageous. The creation of a region of liquid (for liquid takeoff) which is isolated from solids feed, especially larger particle size solids, provides a liquid that may be relatively effectively extracted. This liquid would thus have reduced need for further separation of the solids entrained in the liquid, as compared to conventional reactors in which there is no freestanding liquid region. Furthermore, the generation of this freestanding liquid region 50, by any of a variety of means, gives solid particles entrained (or suspended) in the process liquid 24 entering the region 50 (along the direction of arrow 23) a greater chance to settle. The solids settling will be facilitated because there will be less turbulence in the area around the fluid flow outlet arrangement 70, compared to conventional reactors. This is because, at least in part, introduced feed solids 51 will generally not be directed into the freestanding liquid region 50. Also, as the process liquid flows from the lower countercurrent reactor region 26 into the freestanding liquid region 50, overall flow rate effectively drops, allowing some settling.

Entrainment of solids in liquid flow depends upon such factors as the viscosity and density of the fluid, the particle density, the particle effective surface area, and the flow velocity of the fluid relative to the particle. By reducing the flow velocity in the freestanding liquid region 50, as a result of effectively increasing the cross-sectional area available to the process water due to segregating out solid particles, and by improving the downward flow of the solids, the amount of solid particles in the freestanding liquid 83 and, thus, entrained in the process liquid 24 extracted from the reactor vessel 20, is greatly reduced. Furthermore, the particle size of the entrained solids is reduced because of these improvements. This is due in part because of the greater chance the larger sized particles have to settle out of the liquid while in the freestanding liquid region 50. Therefore, even carbonaceous solids, such as biomass, including fractions, e.g., up to about 50%, with a relatively small particle size, as for example less than about ¼ inch (6 mm), can be advantageously beneficiated using the system of the present invention. Again, this is, at least in part, further facilitated because the reactor vessel 20, with its retaining structure 40, provides an enhanced downward flow of relatively low density and small particle solids due to the downward force of the retained solids 85. Furthermore, although water is not required to be used by the present method and system, it is preferred, and may be used with solids possessing a density close to that of water because of this enhanced countercurrent flow.

The retaining structure 40 may be affixed to the reactor vessel's internal side wall 25 by any suitable mounting means. The mounting means or arrangement 91 shown in the preferred embodiment of FIG. 4, comprises welding struts 92. An alternate embodiment would be to affix the retaining structure 40 to the reactor vessel's internal top wall 80 by hanging welding struts (not shown in FIG. 4).

By whatever means the retaining structure 40 is affixed to the reactor vessel 20, the internal volume 41 circumscribed by the retaining structure wall 42 should be provided generally clear of obstruction, so that the introduced feed solids 51 may be readily fed into the lower countercurrent reactor region 26 therethrough (i.e., outwardly from the bottom edge 45).

In order to conserve resources, e.g., financial and natural, it is advantageous to reduce the total volume of fluid, e.g., water, necessary for effectively beneficiating carbonaceous solids on a commercial scale. Therefore, it would be desirable, for example, to recycle the processing liquids and utilize the heat contained therein relatively efficiently. Certain systems for beneficiating low rank coals by the countercurrent hydrothermal reforming process extract a relatively substantial amount of fluid from the reactor arrangement to be used, for example, in preheating the feed solids. This is typically done, however, at a location below the hydrothermal reforming reaction zone, which, as discussed in more detail below, is a relatively inefficient utilization of the heat content of the liquid. Furthermore, since recycling of the processing liquids is desirable, it is also advantageous to extract processing liquids without a large amount of solids contained therein. A preferred reactor arrangement of the present invention provides an improved extraction system and method, at least in part, because of a reduction in the amount of suspended solids extracted therewith.

During operation of a preferred embodiment as shown in FIG. 4, the process liquid 24 in the freestanding liquid region 50, i.e., referred to herein as the freestanding liquid 83, is extracted via fluid flow outlet arrangement 70. This extraction occurs at or below the freestanding liquid surface 89 by means of a fluid flow outlet port 72 and a fluid flow outlet conduit 74. The rate of removal of the process liquid is controlled by a fluid flow outlet control valve 76 and pump 52'. The freestanding liquid 83 generally drains more easily than liquid does from conventional reactors because the downwardly moving bed of carbonaceous solids 22 is not in direct solids flow communication with the fluid flow outlet port 72. Furthermore, because the freestanding liquid 83 is less turbulent, as discussed above, suspended solids therein are allowed to settle to a greater extent.

It is to be understood that in some applications a plurality of the fluid flow outlet arrangements 70 may be used to advantage. In such a reactor arrangement, fluid flow outlet ports, such as port 72, for example, could be distributed approximately equidistant from each other, around the internal side wall 25 of the reactor vessel 20. A plurality of fluid flow outlet arrangements 70 is advantageous because it allows for a distribution of the fluid flow within the freestanding liquid region 50, which results in a further reduction in the liquid flow velocity and resultant turbulence in the freestanding liquid region 50. Similar advantages result from use of a plurality of overflow drains 78.

The retaining structure 40 preferably possesses dimensions that produce efficient and economical extraction of process liquid. As shown in the preferred embodiment in FIG. 4, the retaining structure 40 extends downward below the freestanding liquid surface 89 to a sufficient extent such that adequate capacitance is provided to satisfactorily meet fluctuations in the level of the freestanding liquid surface 89 relative to the fluid flow outlet port 72. That is, the height of the retaining structure wall 42 is preferably sufficient to allow for fluctuations in the rate of extracted fluid flow due to the demand for the process liquid 24 at the highest expected extraction rate without the level of the freestanding liquid surface 89 generally falling below the level of the fluid flow outlet port 72. Furthermore, the retaining structure 40 preferably extends downward below the freestanding liquid surface 89 to a sufficient extent such that the turbulence induced upon fluid flow extraction at the highest expected extraction rate is below that which would entrain solid particles of a size that would result in uneconomical filtration after extraction of the process liquid 24. It is to be understood, however, that filtering systems, such as screens, filters, etc., may be useable with outlet flow from the reactor arrangement of the present invention, in order to entrap very slow settling fines. Also, the retaining structure 40 preferably does not extend downward below approximately the minimum depth necessary to meet the above objectives. If it were to exceed this depth, there would be a general reduction in the efficiency of heat transfer between the descending bed of carbonaceous solids 22 and the process liquid 24 contained within the internal volume 41 of the retaining structure 40, due to unnecessary stagnation of the liquid in the retained solids section. To compensate for this, it would be necessary to increase the height of the reactor vessel 20, which would result in a less economical reactor design. For a typical reactor vessel with a height of 60 to 100 feet (about 18 to 30 meters), the retaining structure 40 is preferably at least about 6 feet high (2.0 meters), with at least approximately 3 feet (1.0 meter) submerged below the level of the freestanding liquid surface 89.

The ring portion 43' of the retaining structure 40 is preferably sufficiently large, e.g., has a sufficiently large cross-sectional diameter if in the form of an annular structure, to retain a large amount of solid material such that rapid and trouble-free feeding of the feed solids 51 into the central circumscribed area, i.e., the internal volume 41 is readily facilitated. Furthermore, ring portion 43' of the retaining structure 40, is sufficiently small, e.g., has a sufficiently small diameter if in the form of an annular structure, to permit a sufficiently large freestanding liquid region 50 such that the influx fluid flow velocity of the process liquid 24 into the region 50 is below that which would fluidize particles of a size that would prohibit economically feasible extraction. That is, the freestanding liquid region 50 should be large enough to allow for a major portion of fluidized solid particles (except, for example, fines) to settle. In other words, the size of the retaining structure 40, and hence the size of the freestanding liquid region 50, should be optimized in view of the possible need to filter extracted liquid to remove entrained particles. It may be economically feasible to remove certain sized particles (fines) along with the process liquid 24, but there is a point approached at which the entrained particles are too large for economical extraction, i.e., extraction without relatively extensive filtration. In a preferred embodiment with an annular retaining structure 40 having a ring portion 43' that mirrors the circular cross-sectional shape of the reactor vessel 20, the diameter of the ring 43' is about 70% to 80% of the diameter of the reactor vessel 20. A typical reactor vessel is about 9 feet (2.7 meters) in diameter (internal), with a volume sufficient to treat about 100 tons ($9.1\times10^4$ kg) of solid material per hour. For a reactor vessel with a diameter of about 9 feet and a cross-sectional area of about 64 $ft^2$ (6 $m^2$), the cross-sectional area of the ring 43', whether it mirrors the circular cross-sectional shape of the reactor vessel 20 or not, is about 45 to 51 $ft^2$.

There is no requirement that the ring portion 43' of retaining structure 40 be impervious to fluid flow through the outer wall 42. However, it will be desirable that it be such as to inhibit substantial solids flow therethrough, so as to inhibit solids flow directly to the freestanding liquid region 50, from the retained solids 85.

Although it is desirable to extract process liquid with little or no entrained particles, this is very difficult to accomplish. The system and method of hydrothermal reforming of a preferred embodiment of the present invention provides improvements in the reduction in the amount of the entrained solids, also a reduction in the size of the particles entrained, particularly if processing parameters, such as fluid flow rate, are optimized. One of the advantageous aspects of this invention is to allow for treatment of materials with fractions containing a relatively small particle size, without a resulting problem of solids entrainment in liquids drawn off. That is, even materials with a significant portion of solid particles less than about ¼ inch (6 mm) may be advantageously beneficiated with the systems and methods of the present invention.

The retaining structure 40 shown in the preferred embodiment of FIG. 4 extends upward above the freestanding liquid surface 89 to a height sufficiently high such that solids being fed into the reactor vessel 20 are generally inhibited from spilling into the freestanding liquid region 50. In an embodiment, such as the one shown in FIG. 4, in which the retaining structure 40 is in communication with the upper portion of the internal sidewall 25, at or near the top wall 80, process gases, such as $CO_2$, in a process gas receiving region 96 should be able to enter the retaining structure internal volume 41. This should be done, however, only to the extent that influx gas flow velocities do not cause extensive turbulence in the retained solids region 16. Depending upon the particle size of the solids, this turbulence could in part reduce the positive effects realized by the presence of the downward force exhibited by the mass of retained solids 85. In addition, gas flow tube 98, discussed in more detail below, extending upward from an upper portion of the lower countercurrent reactor region 26 through the freestanding liquid region 50, should be arranged such that ejected gases, liquids, and solids are transported essentially completely into the retaining structure internal volume 41, and above the retained solids 85.

The retaining structure 40 may be constructed of any material suited to economical survival within the environment of the reactor vessel. This may include, but is not limited to, steel of approximately ⅛ inch (3 mm) thickness of a suitable composition that withstands abrasion and corrosion, such as mild steel. In some embodiments, not shown, the retaining ring portion 43' of structure 40 may have a wall 42 that is perforated. In such an embodiment the size of the perforations should allow process liquid 24 and gases to pass through the perforations, but generally not allow solid material in the retained solids region 46 to pass through into the freestanding liquid region 50.

Gas Flow Tubes

As stated above, carbonaceous materials beneficiate under pressure and when in communication with hot water by the expulsion of inherent water due, at least in part, to the conversion of carboxyl groups to carbon dioxide. The carbon dioxide and other gases produced by the hydrothermal reforming process, such as water vapor, carbon monoxide, methane, and sulfur dioxide, are herein referred to as the process gases. These process gases migrate upward in the reactor vessel 20 because of the lower density of each of the gases relative to the liquids and solids.

Generally, it is observed that the process gases are generated in an amount sufficient to obstruct or disturb the downward flow of the bed of carbonaceous solids 22 countercurrent to the upward flow of the process liquid 24. That is, as the gases flow upward through the downwardly moving bed of solids 22, turbulence or disruption in the continuous and even countercurrent flow may result. This disturbance causes an increase in the heterogeneous stirring of the countercurrent flow, which can result in a reduction in the efficiency of the heat transfer between the process liquid 24 and the descending carbonaceous solids 22. Furthermore, the upward flow of gases may also cause turbulence in the freestanding liquid 83, which would disturb the settling process of the solids from the liquid. Additionally, for certain carbonaceous solids with a high concentration of oxygen, the rate of carbon dioxide evolution may be sufficient to seriously impair the continuous flow of solids, which would lead to an inefficient system.

In a preferred embodiment of the present invention, there is provided means for removing, or shunting, process gases formed in the lower countercurrent reactor region 26, in a manner which generally reduces disruption to the countercurrent flow. The insertion of a gas flow tube 98 (as seen in FIG. 4), i.e., a "bubble breaker," provides for a means to divert or shunt at least a portion of the carbon dioxide and other gases (along the direction of arrow 111) produced around a portion of the pile of submerged solids 84. Additional advantage is observed if a plurality of the gas flow tubes 98 are used. This added means will greatly obviate the problem of the disturbed countercurrent flow.

A gas flow tube 98 as shown in FIG. 4, comprises a conduit 112 having a first end 113 and a second end 114. The second end 114 projects into the lower countercurrent reactor region 26, preferably terminating in the lower part of the coal preheat zone 29. It is desirable to have the second end 114 high enough up in the coal preheat region 29 so that generally most of the steam associated with the gas can condense, but low enough in the coal preheat zone so that heterogeneous mixing due to the turbulence caused by ascending bubbles is somewhat minimized. The gas flow tube second end 114 is preferably covered with a protective arrangement (not shown) with small enough openings to prevent large particles from being transferred into the conduit 112.

The second end 114 of the gas flow tube 98 is also preferably placed low enough in the lower countercurrent reactor region 26 such that a static pressure differential maintained between the upper and lower countercurrent reactor regions 26 and 48, respectively, provides for efficient and rapid transfer of the process gases from the point of formation, i.e., in the reaction zone 28, to the process gas receiving region 96, along the direction of arrow 111.

In the preferred embodiment of FIG. 4, the first end 113 of the gas flow tube 98 is located within the process gas receiving region 96 of the reactor vessel 20, and is preferably directed in such a way that liquid entrained by the rapid transport of the process gases along the direction of arrow 111 through the gas flow tube 98 will impinge upon the retained solids 85, so as not to cause undesired turbulence in the freestanding liquid 83. In FIG. 4, this is provided by a bend 118 in the gas flow tube 98 near the first end 113. During operation, the gas flow tube 98 may occasionally have the appearance of a percolator with streams of hot water being ejected by bursts of low pressure gas. If the diameter of the gas flow tube 98 is large enough, however, the transport of the process liquid 24 can be reduced. A typical gas flow tube 98 has a diameter in the range of about 3 inches to 6 inches. Referring to FIG. 4, the tube 98 shown extends through upper portion 43 of retaining structure 40. While advantage is derived from such placement, and from a plurality of tubes 98 so placed, in some applications it may be desirable to position a similar tube or tubes centrally, i.e., to project through a central portion of ring portion 43'. It may be desirable, for tubes so placed, to provide an inverted U-bend in an upper end, to inhibit plugging from the solids feed.

Solids Feed System

Reactor arrangements of the present invention, as do conventional arrangements, require carbonaceous solids to be delivered from ambient pressure, or near ambient pressure, to the operating pressure of the reactor vessel. Hydraulic lockhoppers are typically used to transfer materials between regions at substantially different pressures. For example, a solid substance is added to a lockhopper at ambient pressure, while the lockhopper is sealed off from the region of higher pressure. Water is then typically added to the lockhopper (hence, hydraulic lockhopper), and the combination is pressurized to that of the region of higher pressure. The lockhopper is then opened to the region of higher pressure and the solid material is charged into the receiving region, along with the liquid that is used to pressurize the lockhopper.

In conventional systems the transfer of the carbonaceous solids into the hydrothermal reforming reactor is generally accomplished using a hydraulic lockhopper, as described above, which is often used in combination with a dewatering means. The purpose of a combined arrangement of a hydraulic lockhopper and dewatering means is to reduce the volume of liquid, which was used to pressurize the lockhopper, entering the reactor vessel upon charging it with the solids. This is done because it is known that superfluous amounts of liquid, e.g., water, may adversely affect the thermodynamics of conventional beneficiating processes. Furthermore, extraneous or superfluous liquid acts as a diluent and necessitates an increase in the volume of liquid effluent treated.

Figure 5:
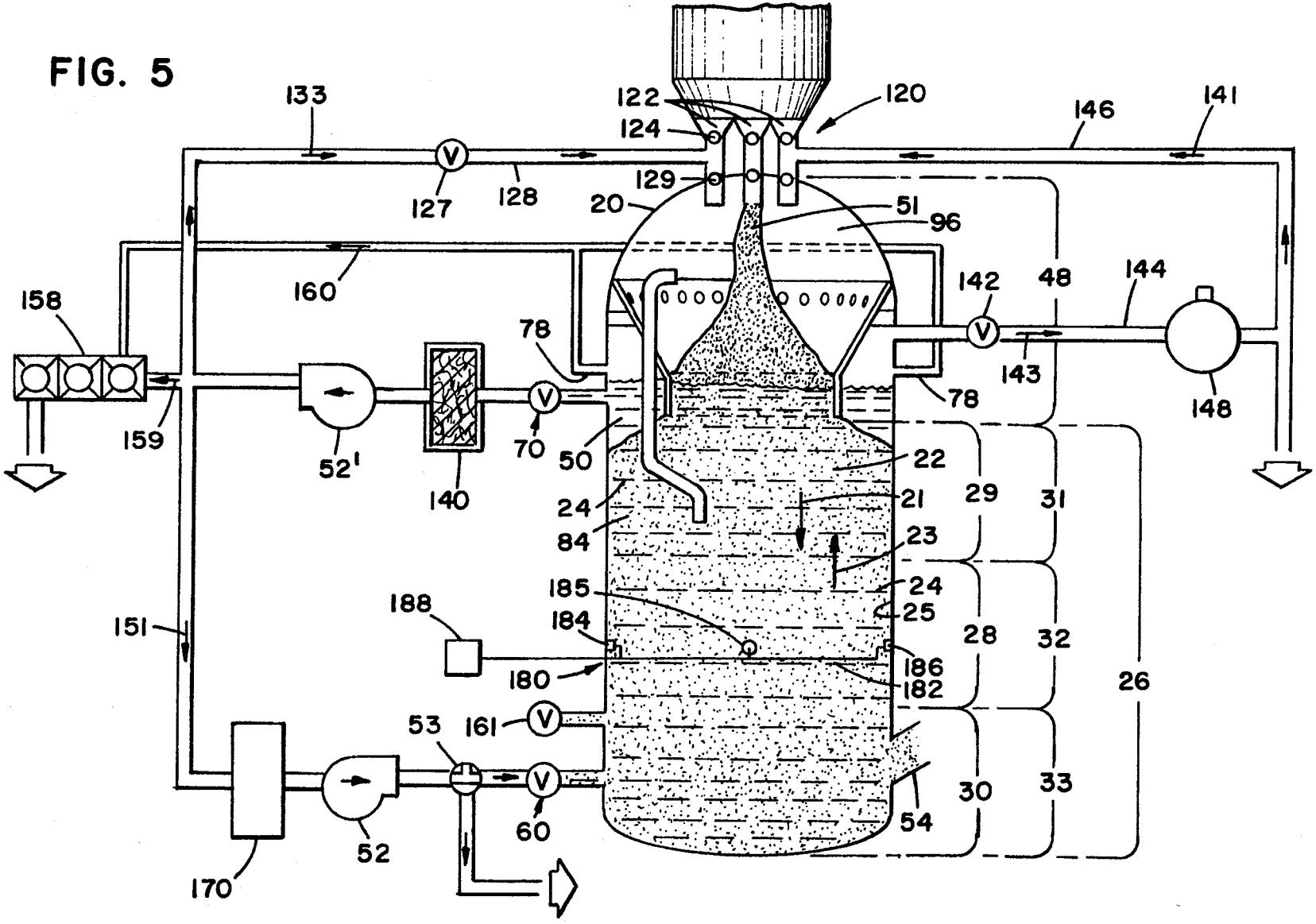
FIG. 5 is a schematic drawing of a reactor arrangement including a reactor vessel and solids feeding means according to the present invention.

A preferred embodiment of the present invention, shown in FIG. 5, uses a solids feed system 120 that accomplishes the goals of charging the reactor with the feed solids while reducing the volume of superfluous liquid added to the reactor vessel. The reactor vessel depiction in FIG. 5 is a vessel 20 as described above, and shown in FIG. 4. The solids are fed to the vessel 20, without the need of a dewatering means, such as a high pressure screw conveyor. Thus, one aspect of a preferred embodiment of the present invention is efficient avoidance of dewatering means prior to charging the reactor 20 with the feed solids 51, without significantly adversely affecting the thermodynamics of the process.

The solids feed system 120 includes use of a feed hydraulic lockhopper 122, e.g., a feed hydraulic lockhopper, for feeding the solids directly into the reactor vessel 20, i.e., without utilizing a system to dewater the solids. The solids feed system 120 includes a solids feed lockhopper inlet valve arrangement 124, a feed lockhopper liquid filling valve arrangement 127, a feed lockhopper liquid conduit arrangement 128, and a feed lockhopper outlet valve arrangement 129. The feed hydraulic lockhopper 122 is preferably pressurized by process liquid 24 extracted from the reactor vessel 20. Although FIG. 5 does not indicate that every lockhopper has a liquid conduit for directing process liquid thereto, it is understood that this is the case. Furthermore, although this description is presented in terms of a conventional hydraulic lockhopper, a more detailed description of a solids feed system and a feed lockhopper specifically designed for advantageous use with the reactor vessel of the present invention appears below.

In operation, carbonaceous solids are transferred from ambient pressure to the operating pressure of a hydrothermal reforming reactor vessel 20 by use of a feed hydraulic lockhopper 122. The feed hydraulic lockhopper 122 is charged and pressurized up to or near the pressure of the reactor vessel 20 using a liquid such as water. In conventional systems, as discussed above, a dewatering means is used to reduce the amount of liquid introduced into a conventional reactor. Because, however, at least a portion of the process liquid 24 is used to charge the solids feed system 120 in a preferred embodiment, the amount of superfluous and extraneous liquid introduced into the reactor 20 is reduced. That is, at least a major portion of the liquid that enters the reactor vessel 20 along with the feed solids 51 has been previously extracted from the reactor vessel 20. Thus, it is not critical to remove surface liquid from the carbonaceous solids before charging the reactor vessel 20 for efficient operation.

As shown in FIG. 5, the solid material is charged into the feed hydraulic lockhopper 122 through the solids feed lockhopper inlet valve arrangement 124. The feed hydraulic lockhopper 122 may be charged with solid materials by any of a variety of means known in the coal processing industry for loading. Although each lockhopper intermittently charges the reactor with solids, it is understood that solid material, such as coal, can be charged continuously to the reactor vessel 20 by the use of a plurality of the lockhoppers 122, which can be sequentially fed by a bunker arrangement (not shown). The rate of the solids feed into the lockhopper 122 may be synchronized with the rate of the lockhopper operation of loading the solid material into the reactor vessel 20 to reduce lockhopper cycle repetition, if so desired.

Process liquid 24 is added to the feed hydraulic lockhopper 122 to charge and pressurize it. This is done by means of the feed lockhopper liquid conduit arrangement 128 along the direction of arrow 133. The process liquid 24 typically contains dissolved and entrained solids and gases that have been released from the carbonaceous solids. Should the lockhopper system require a minimum-size entrained particle for normal operation of the lockhopper liquid filling valve arrangement 127, the process liquid delivered to the feed hydraulic lockhopper 122 can be filtered by any of a variety of means known in the art, such as a filter 140, to such an extent as to meet the necessary standards for efficient operation of the solids feed system 120. Fluid flow may be controlled by a variety of pump means, symbolized at 52'. Feed hydraulic lockhoppers are described in the literature; see, for example, U.S. Pat. No. 3,729,105.

The solid material is discharged from the solids feed hydraulic lockhopper 122 into the reactor vessel 20 through feed lockhopper outlet valve arrangement 129. Both the inlet valve arrangement 124 and the outlet valve arrangement 129 may be simple open/shut valves of existing art, as for example, a high pressure ball valve. For ease of maintenance, the inlet and outlet valve arrangements 124 and 129, respectively, are preferably double valved. That is, there are actually two valves for each of the lockhopper inlet and outlet, one of which can be disabled for repair without interrupting the operation of the process.

A more detailed discussion of a solids feed system is discussed in further detail below (see FIGS. 10–12). A lockhopper arrangement including means for reducing gas pressure from the lockhopper and means for charging and pressurizing the lockhopper with liquid is discussed in greater detail. This arrangement includes a unique and preferred valve arrangement for delivering solids to the reactor vessel while under a first pressure and receiving solids while under a second, lower, pressure.

Because preferred embodiments of the present invention charge both solids and liquid into the reactor and do not use a dewatering system, advantage is realized. In addition to the advantage of not using a dewatering system, as discussed above, advantage is realized because of a simplification in the feed lockhopper valve arrangements, particularly outlet valve arrangement 129. If a dewatering system such as a screw conveyor is used, it is usually necessary to control the solids flow from the feed lockhopper into the screw conveyor. This is generally necessary to prevent overloading and plugging of the dewatering system. In such arrangements, an outlet valve capable of controlling this solids flow is known to often become easily plugged. Thus, a simplified feed lockhopper outlet valve arrangement 129 that does not become easily plugged is an advantage and is preferred in the present invention.

If the nature of the solids feed is such that an additional impetus is necessary to initiate the falling of the wet feed solids 51 into the reactor vessel 20, due, for example, to the existence of a hydraulic lock present after the opening of the feed lockhopper outlet valve arrangement 129, a portion of the process gases from the process gas receiving region 96 in the upper countercurrent reactor region 48 may be charged into the feed hydraulic lockhopper 122 (along the direction of arrow 141) to force the material downward by pressure. The process gases are removed from the process gas receiving region 96 through a vent arrangement 142 (along the direction of arrow 143) and transported to the feed hydraulic lockhopper 122 through the gas flow outlet conduit 144 and the feed lockhopper gas conduit 146. (FIG. 5 indicates process gas is directed to only one lockhopper in order to simplify the diagram.) The process gases are preferably pressurized to a pressure slightly greater, i.e., about 50–70 psi, than that in the upper countercurrent reactor region 48, by the gas compressor arrangement 148. As will be seen elsewhere in this description, it may also be desirable to compress a portion of the process gases extracted from the upper countercurrent reactor region 48 for use in discharging the beneficiated solids.

In certain situations it may be desirable to wash the interior of the feed hydraulic lockhopper 122 with liquid to enhance the transfer of solids from the lockhopper 122 to the reactor vessel 20. In these situations a spray of liquid may be provided by a feed lockhopper liquid spray system (not shown in FIG. 5). The source of liquid for this washing/spraying process is preferably the same as used in pressurizing the feed hydraulic lockhopper 122, i.e., the slightly pressurized extracted process liquid 24. It is noted that the process liquid 24 used for the spray as well as that used to pressurize the feed hydraulic lockhopper 122 is recycled back into the reactor vessel 20. Therefore, in a preferred embodiment of the present invention there is generally little, if any, net increase in the amount of liquid introduced into the reactor vessel 20 by either the washing process or the pressurizing process. Again, excess water, for example from the beneficiation itself, is drawn off through overflow drain orifice 78, to water treatment.

Again, the use of a high pressure screw conveyor to dewater solids from a hydraulic lockhopper before charging the reactor has been preferably eliminated. This is because the addition of superfluous liquid has been reduced due to the fact that at least a major portion of the liquid in the feed hydraulic lockhopper 122 is from the reactor vessel 20, i.e., that is recycled. Therefore, after initial start-up of the reactor, little additional liquid is introduced into the reactor vessel 20, beyond what is contained in the solids themselves and from the introduction of steam for a supplying thermal energy, as discussed below. Thus, the feed solids 51 can be advantageously charged directly into the reactor vessel 20 from the feed hydraulic lockhopper 122. In sum, the preferred embodiment of the present invention generally: avoids need for the high pressure screw dewatering conveyor; eliminates need for a control valve that varies the solids flow from the lockhoppers, which may become easily plugged; and, reduces the amount of superfluous liquid entering into the reactor vessel.

In addition to the process liquid 24 from the reactor vessel 20 being directed to the solids feed system 120, at least a portion of the process liquid 24 extracted from the freestanding liquid region 50 is directed through the fluid flow outlet arrangement 70 to the fluid flow inlet arrangement 60 (along the direction of arrow 151) and recycled into the reactor vessel 20. For both general uses, it is preferable to raise the pressure of a portion of this extracted process liquid 24 slightly above, i.e., about 50–70 psi above, that existing in the upper countercurrent reactor region 48. This liquid may be pressurized by a pump 52 and/or 52', as shown in FIG. 5, which may be of a variety of types, with encapsulated motors. Additionally, valve arrangement 53 may be used to direct fluid flow to a solids discharging system, which operates out of opening 54 and is discussed below.

A certain volume of the process liquid 24, preferably water, containing water removed from the beneficiated materials, may also need to be removed from the system at various times throughout the beneficiation process. This is because the water removed from the beneficiated solids adds to the total volume of the process liquid, and for effective thermodynamic processes to occur some of the liquid preferably is removed. Thus, at least a portion of the process liquid 24 may be directed to a water treatment system 158 along the direction of arrow 159. Again, it may also be directed to system 158 via overflow orifice 78 along the direction of arrow 160.

It is noted that preferred applications and arrangements of the present invention do not include extractions of any fluid from below the area in the lower countercurrent reactor region 26 in which the hydrothermal reforming reaction occurs, i.e., the reaction zone 28. In certain conventional beneficiation systems, the extraction occurs essentially in or near the lower portion of the lower countercurrent reactor region. The liquid extracted from this region (in conventional systems) has often been used to preheat the carbonaceous solids before they are charged into the reactor. However, this is not necessarily a very efficient use of energy resources. This is because the process liquid extracted from the lower portion of the lower countercurrent reactor region generally has a relatively high thermal energy content. This is then applied to a solids material with a relatively low thermal energy content. It will become apparent through the discussion below that it is more efficient to utilize the system and method defined in a preferred embodiment of the present invention for applying heat recovery to the process.

During the operation of a preferred reactor arrangement as shown in FIG. 5, the process liquid 24 (moving along the direction of arrow 23) that has gone through the reaction zone 28 is used to preheat the downwardly moving solids 22 (moving along the direction of arrow 21) as they enter the reaction zone 28. The heat transfer occurs by means of this countercurrent flow. Once at least a portion of the heat contained in the process liquid 24 has been used in this manner, the process liquid 24 is removed from the upper countercurrent reactor region 48 and is preferably pressurized by the extraction pump 52'. The process liquid 24 is then directed to the solids feed system 120 (along the direction of arrow 133) where it pressurizes the feed hydraulic lockhopper 122 and heats the solids somewhat before they are charged into the reactor 20. Because the process liquid 24 is removed from the upper countercurrent reactor region 48, advantage is realized. In particular, this is generally the location in the reactor at which the process liquid 24 is the coolest, which results in greater thermal efficiency and a reduction in mixing enthalpies. That is, reducing increments of mixing enthalpies in heat exchange reduces the increase in entropy of the system. This makes available more energy for harnessing as work.

Recirculation Heat Exchange-Combined Electric Operation

Generally, in conventional systems steam is used as a source of heat for proper operation of reactor vessels for such operations. Steam is generally and preferably introduced into the lower portion 33 of the lower countercurrent reactor region. Steam may be used in some systems and processes according to the present invention and introduced at steam input arrangement 161 (FIG. 5); however, it would be advantageous to use alternate sources of thermal energy for a number of reasons which will become apparent from the following discussion. For example, steam adds extraneous water into the system, which as discussed above can be detrimental. Therefore, it is advantageous to reduce the amount of steam put into the hydrothermal reforming system, by either heat recovery methods or by secondary sources of energy.

A preferred embodiment of the present invention utilizes a relatively efficient method of applying heat recovery to the process of hydrothermal reforming of low rank coals. As discussed above, this method reduces the introduction of extraneous liquid into the process, and involves removal of the process liquid 24 from the reactor vessel 20 at a location above the hydrothermal reforming reaction zone 28. This method of heat recovery results from preferably allowing for the removal of the process liquid 24 from the reactor vessel 20 and through the fluid flow outlet arrangement 70, and recirculation of this liquid (along the direction of arrow 151) back into the reactor vessel 20 for utilization of the thermal energy contained therein.

In a preferred embodiment of relatively efficient heat recovery in this system (see FIG. 5), process liquid is extracted from the upper countercurrent reactor region 48. The amount that is extracted preferably provides or results in a sufficient flow of the upwardly moving liquid to effectively beneficiate the solids. That is, the amount of liquid extracted will affect the fluid flow. This fluid flow should be sufficient to flush the water associated with the descending solids 22, e.g., inherent water, out of the solids 22 and into the liquid 24 in the hydrothermal reforming reaction zone 28 where it proceeds upward. As stated previously, the location in the reactor vessel 20 at which the process liquid 24 is preferably removed is that level or region in the reactor at which the process liquid 24 is generally the coolest. Thus, the process liquid is removed from the upper countercurrent reactor region 48. Once the upwardly moving process liquid 24 reaches region 48 a large portion of thermal energy contained within the process liquid 24 has been removed and transferred to the descending submerged solids 84 in the hydrothermal reforming reaction zone 28.

The process liquid 24 that is recycled back into the reactor vessel 20 through the fluid flow inlet arrangement 60 is preferably in an amount and rate that is just sufficient to provide the desired temperature of the wet processed solids before they are discharged from the reactor vessel 20. That is, a sufficient amount of the recirculated process liquid 24 is introduced into the reactor vessel 20 such that the process liquid 24 cools the beneficiated solids to a desired temperature level before removal. In certain circumstances, such as operation under nonequilibrium conditions, it may be advantageous to provide a means for further cooling the recirculated water, such as by a heat exchanger 170. Generally, however, during stabilized operation, i.e., equilibrium operating conditions, the temperature of the process liquid 24 in the upper countercurrent reactor region 48 is sufficiently cool for recirculation directly back into the reactor vessel 20 through the fluid flow inlet arrangement 60. Furthermore, during stabilized operation, the solids have been retained in the reactor for a sufficient length of time for the heat exchange process to cool the solids to the desired exit temperature.

Additionally, it may be desirable to provide a secondary source of thermal energy. This secondary source may result from the use of electrical energy. The use of electrical energy to provide thermal energy to the operation of the process has certain advantages. For example, the dilution of effluents in the waste extraction water stream caused by using steam as the sole process heat source can be reduced. The waste stream may, therefore, be highly concentrated, and thus more efficiently treated, by partially replacing steam heat with electrical energy. Also, the use of electrical energy as a supplemental means for providing thermal energy removes the limitations resulting from total dependence on a steam supply and its limited capacity. Thus, the combined use of steam and electrical energy as a means for providing thermal energy to the system of the present invention makes possible the use of steam from an existing steam supplier. Furthermore, this combined use may result in more rapid initiation of the carbonization reaction, and may allow for the down-sizing of the steam generation equipment by designing the equipment for steady-state rather than start-up conditions. Finally, electrical energy provides a reliable back-up source of energy, with instantaneous control, when the steam generation equipment is shut down for maintenance or other purposes.

Although electrical energy may be introduced into the reactor vessel 20 in a variety of ways, it is preferably introduced at a position relative to the height of the column of the bed of submerged solids 84 such that an optimum amount of thermal energy is input. In the electrical energy system 180, the resistive element 182 may be the process liquid 24 itself, since it will include salts derived from the bed of solids. Generally a three phase alternating current power using the electrodes 184, 185, and 186, which are distributed approximately equidistant from each other near the reactor vessel's internal side wall 25, as shown in FIG. 5, will provide a good distribution of thermal energy. The rate of heating can be controlled by existing power control means and techniques. Examples of a power control system 188 are transforming voltage control, or solid-state rectifier control. The internal side wall, in this application, should, of course, be electrically insulated, for example, by existing methods such as ceramic, plastic, or organic linings or coatings.

Solids Discharge System

Known countercurrent extraction systems for treatment of, for example, coal, generally use solids discharge systems that release the solids, and liquid, into a conduit and control valve arrangement that transports the combined solids/liquid to a product hydraulic lockhopper. Such conduit/control valve arrangements sometimes have problems from plugging. A reactor vessel under pressure and containing a densely packed distribution of different sized lumps, all immersed in a process fluid, will generally jam at the control valve unless either: the valve opening and entry/exit conduit is large in relation to the particle size; or, a positive means of relatively vigorously agitating or stirring the packed bed is achieved. What will be preferred in systems according to the present invention is an arrangement that does not typically and readily become plugged and that does not require vigorous agitation of the packed bed, but which provides a controlled positive removal of the solids. It will also be desired that the removal arrangement also not result in a significant draw of process fluid, which would interfere with the hydrothermal reforming process.

Figure 6:
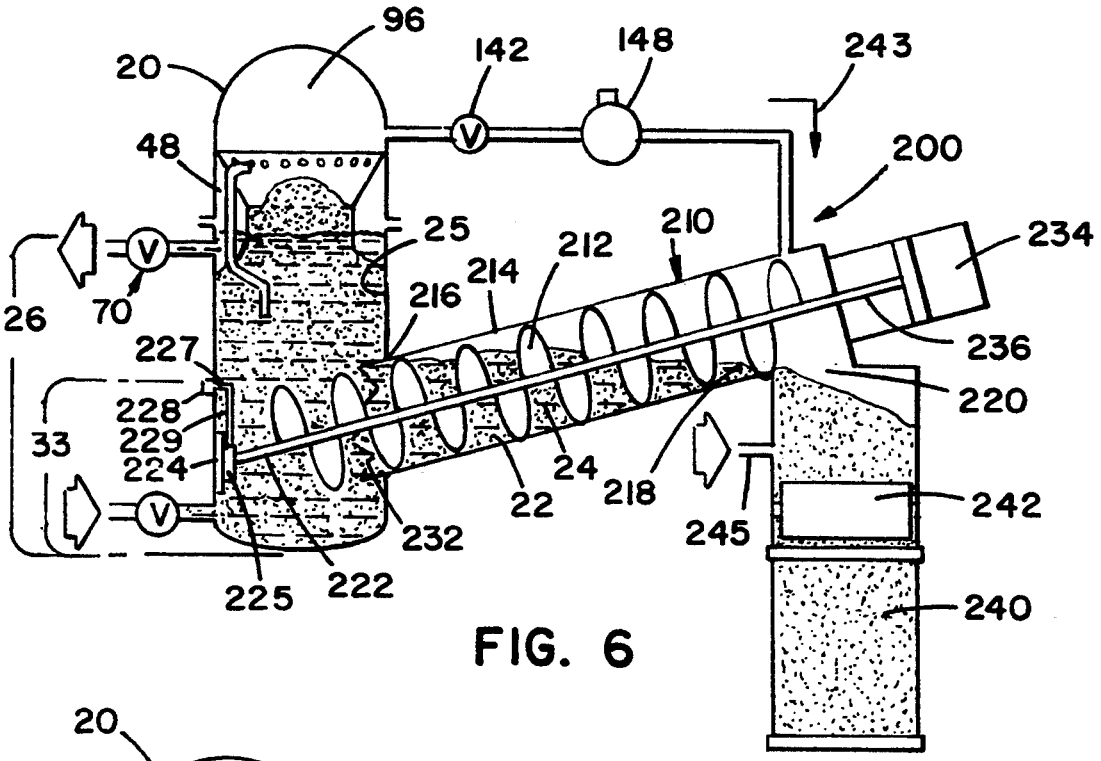
FIG. 6 is a schematic drawing of a screw conveyor extraction arrangement for solids discharge.
Figure 7:
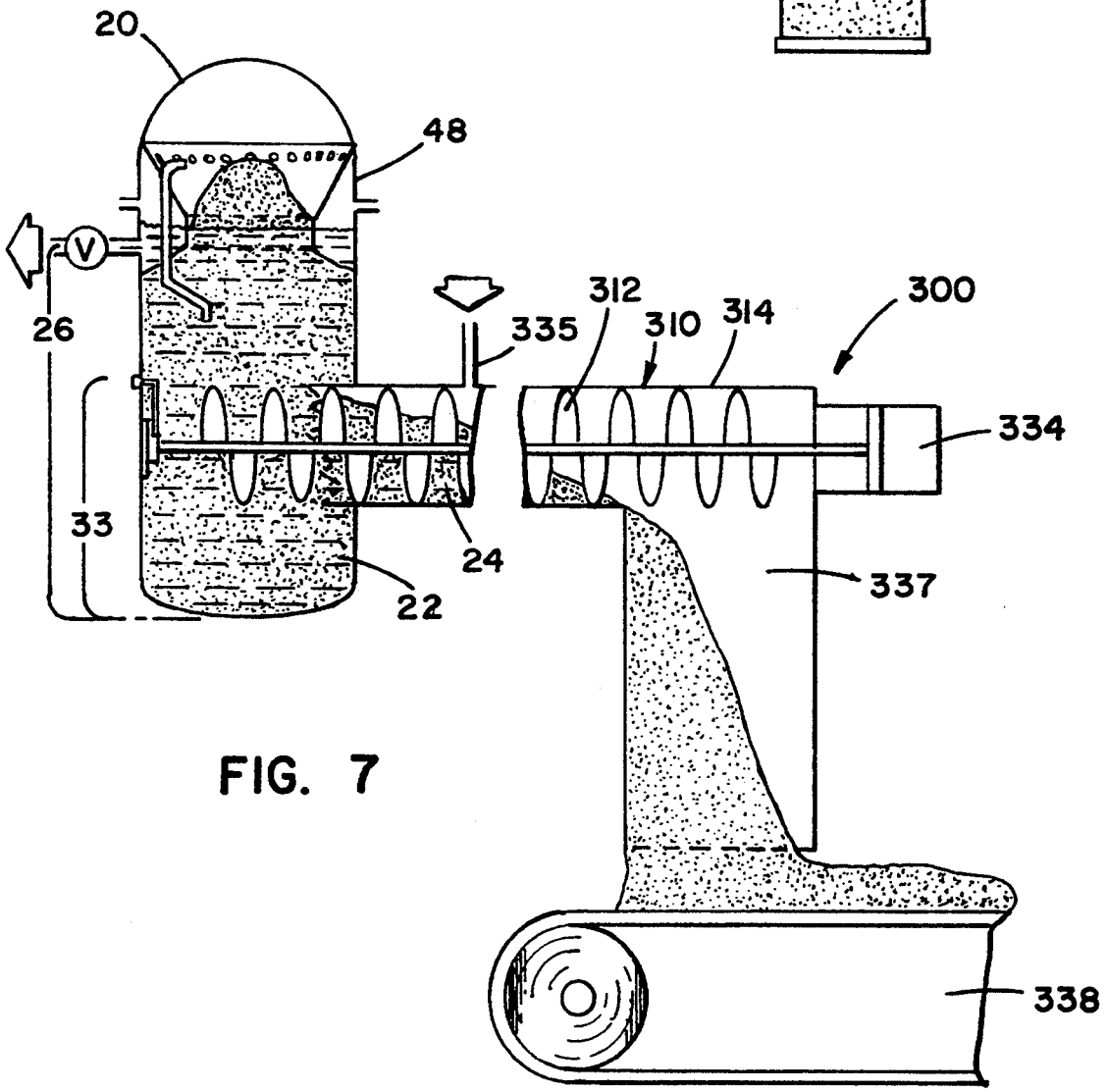
FIG. 7 is a schematic drawing of an alternate embodiment of a screw conveyor extraction arrangement for solids discharge.
Figure 8:
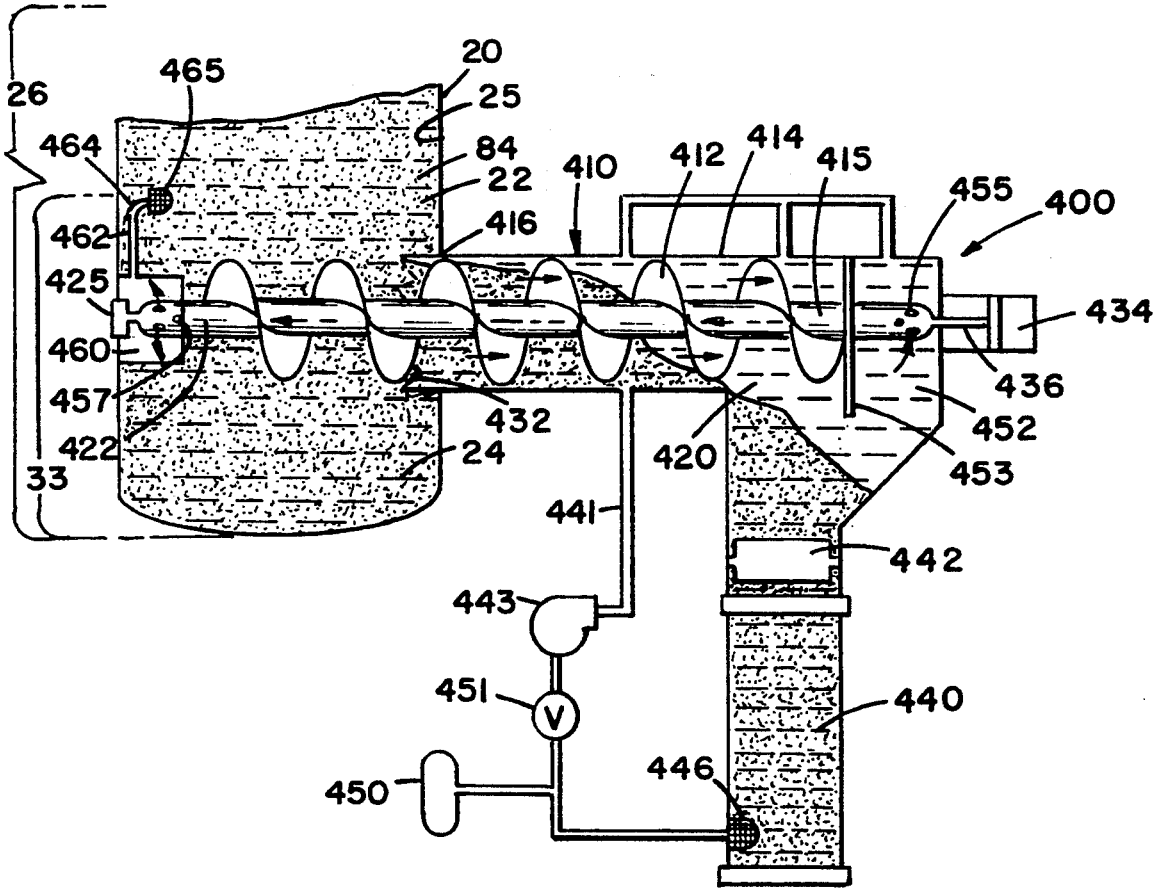
FIG. 8 is a schematic drawing of a hollow extraction auger arrangement for solids discharge.

Preferred applications of the present invention include an improved method for the removal of carbonaceous solids, the majority of which has been processed, i.e., beneficiated, from the reactor vessel 20. This improvement simplifies construction of the lower portion 33 of the lower countercurrent reactor region 26, and in some ways reduces the chance of process failure by plugging. The present invention addresses these problems by the use of means for discharging solids that do not become readily plugged, and that provide a controlled positive removal of solids. Herein, there are described several embodiments of such a system, each with individual advantages, which will become apparent from the following discussions. FIGS. 6–8 are representative of these embodiments and are not meant to be interpreted as showing the relative size of components.

A. Screw Conveyor Extraction

One embodiment including means for discharging solids with the above-listed advantages is the solids discharge system 200 shown in FIG. 6. For FIG. 6, the reactor 20 may be as described above for FIG. 4, although there is no requirement that it be so. Screw conveyor 210, as shown in FIG. 6, comprises an auger 212 located within an enclosure 214, and inserted through a solids discharge opening 216 in the reactor internal side wall 25 within the lower portion 33 of the lower countercurrent reactor region 26. In a preferred embodiment, the screw conveyor 210 is angled upward with sufficient elevation to maintain the liquidus level 218 below an exit opening 220 of the auger enclosure 214. During operation, this positioning advantageously allows for a controlled, positive removal of the beneficiated carbonaceous solids 22 from the reactor vessel 20 while inhibiting extraneous flow of the process liquid 24 with the solids 22. That is, the beneficiated solids are positively removed and not just allowed to pass out of the reactor under the influence of gravity alone. In this embodiment, the screw conveyor 210 simultaneously acts as a solids extractor and dewatering screw. It will be understood that in some applications of the present invention, a plurality of screw conveyors 210 may be used to advantage.

In order to provide adequate bearing strength for the screw conveyor 210, it is desirable to affix a first end 222 of the auger 212 to the internal side wall 25 of the reactor vessel 20 at a position that is opposite the opening 216. This can be done, for example, by using a pad 224 with a bearing 225 attached thereto. Such an arrangement can be produced without penetration of the reactor side wall 25 opposite the opening 216. In order to periodically apply a lubricant, such as grease, to the bearing 225, a grease fitting opening 227 in the internal side wall 25 near the pad 224 and the bearing 225 arrangement is preferably fitted with a grease fitting 228 and a line 229 for transfer of the grease to the bearing 225.

It is also desirable, for the preferred embodiment of FIG. 6, to provide a serrated edge 232 at the point where the auger 212 enters the enclosure 214 at or near the internal sidewall 25 of the reactor 20. The serrated edge 232 advantageously shears large solid particles, in its vicinity, which would otherwise have a tendency to jam the auger 212 during operation. A drive motor 234 is affixed to a second end 236 of the auger 212 to control the rate of withdrawal of the beneficiated carbonaceous solids 22 from the reactor vessel 20. Any of a variety of drive motors may be used, as for example, a reversing variable speed encapsulated motor.

During operation of the hydrothermal reforming (i.e., beneficiating) system, the wet beneficiated carbonaceous solids 22, generally free of the extraneous process liquid 24, are preferably transferred, as for example by dropping, from the screw conveyor 210 through the exit opening 220 in the enclosure 214 into a product lockhopper 240. In certain situations, it may be desirable to provide a toggling tripper 242 to direct the drop of wet solid material into a plurality of the product lockhoppers 240.

In a preferred arrangement, the process gases are directed to the screw conveyor 210 (along the direction of arrow 243) from the process gas receiving region 96 through the vent arrangement 142. The process gases are preferably pressurized by the gas compressor 148 to a sufficient pressure such that the liquidus level 218 within the screw conveyor 210 is maintained below the auger second end 236 to prevent discharge of the process liquid 24 along with the beneficiated carbonaceous solids 22. Generally, pressure about 50 to 70 psi in excess of the pressure of the gases in the process gas receiving region 96 is sufficient.

Hydraulic lockhoppers are preferably used as the product lockhopper 240 for discharging the beneficiated carbonaceous solids 22 to ambient pressure, from the reactor vessel 20, which is at an elevated pressure. In such situations, the fluid used to fill the lockhopper is preferably the process liquid 24, which has been removed from the upper countercurrent reactor region 48 via the fluid flow outlet arrangement 70, directed to and through the product lockhopper liquid conduit 245 (although direct connection between 70 and 245 is not shown in FIG. 6), and used as a spray to flush the product into the product lockhopper 240.

The solids discharge system 200 provides a means for transferring the beneficiated carbonaceous solids 22 from the reactor vessel 20 into the lockhopper 240 in a controlled and generally nonplugging manner. In this embodiment, the process liquid 24 is generally separated from the beneficiated solids 22 being extracted from the reactor vessel 20. That is, generally only processed, i.e., beneficiated, solids are discharged from the reactor. This is not intended to mean, however, that there is no surface and/or residual process liquids associated with the removed solids, nor does it mean that the solids are thoroughly beneficiated. Also, in this embodiment the product lockhopper 240 may either operate with the wet beneficiated solids product alone, or it may operate as a hydraulic lockhopper filled with the process liquid 24, a portion of which is extracted from the upper countercurrent reactor region 46 and directed to the lockhopper 240. The use of extracted upper reactor process liquid to fill the product lockhoppers provides a thermodynamic advantage because use of extraction liquid in lieu of reactor bottom process liquid keeps the process liquid flowing in the right direction, i.e., upwardly in the reactor.

The solids discharge system 200 allows for positive extraction of the beneficiated solids with reduced likelihood of plugging, generally without removal of relatively large amounts of processing liquids, and generally without vigorously stirring the packed bed of solids.

Alternatively, a screw conveyor or plurality of screw conveyors, analogous to the screw conveyor 210, may be positioned such that the exit opening is located generally below the liquidus level. In this embodiment, no gas blanket is used, i.e., no process gases are directed to the screw conveyor, and the beneficiated carbonaceous solids dropped into the product lockhopper are immersed in the process liquid. Either the process liquid from the lower countercurrent reactor region may be used to fill the product lockhopper, the liquid separated from the solids upon release from the lockhoppers, pressurized and reinjected at the screw conveyor entrance, i.e., creating a circulating loop of process liquid, or the process liquid that has been slightly pressurized by the extraction pump (shown in FIG. 5) may be injected into the solids stream exiting the reactor vessel at the juncture of the screw conveyor at the reactor vessel, as in the solids discharge system 200 discussed above.

B. Alternate Embodiment of Screw Conveyor Extraction

An alternate embodiment for discharging beneficiated carbonaceous solids is particularly well adapted for use when the beneficiated solid material consists of a relatively large proportion of fine particles, i.e., contains at least 40% by weight of particles having a size less than about 0.1 inch (2.5 mm). This embodiment allows for direct extraction, i.e., without going through a system such as a lockhopper, of the solid particles to ambient pressure. For FIG. 7, the reactor 20 may be as described above for FIG. 4, although there is no requirement that it be so. In this embodiment, as shown in FIG. 7, the solids discharge system 300 comprises a long and the narrow screw conveyor 310 with a long auger 312 within the enclosure 314. It will be understood that in some applications a plurality of screw conveyors 310 may be used, to advantage. The auger 312 is attached to a drive motor 334 and to the reactor 20 in a manner similar to that of the screw conveyor 210 discussed above. The screw conveyor 310 and the auger 312 are typically narrower in cross section than the screw conveyor 210 and the auger 212 discussed above. This longer and narrower arrangement allows for direct discharge of the beneficiated carbonaceous solids 22 to ambient pressure from the pressurized reactor vessel 20. The pressure drop is generally distributed over the length of the screw conveyor 310. At least a portion of the process liquid 24 is withdrawn from the lower portion 33 of the lower countercurrent reactor region 26 while this solids discharge system 300 is in use. This is generally replaced by the slightly pressurized process liquid 24 extracted from the upper countercurrent reactor region 48, which is injected into the solids discharge system 300 through the screw conveyor liquid conduit 335 at a location that is intermediate between the point at which the solids 22 are initially collected by the auger 312, and the point at which the solids 22 are discharged to ambient pressure through the chute 337 and onto the conveyor 338. In some modifications, liquid discharged from the screw conveyor(s) can be collected, pressurized, and reinjected at 335.

C. Hollow Extraction Auger

Another embodiment of means for discharging solids is the solids discharge system 400, is shown in FIG. 8. For FIG. 8, the reactor 20 may be as described above for FIG. 4, although there is no requirement that it be so. Referring to FIG. 8 beneficiated solids from the densely packed submerged solids 84 can be continuously extracted from the lower portion 33 of the lower countercurrent reactor region 26 with the use of a hollow core screw conveyor arrangement 410. In some applications, a plurality of screw conveyor arrangements 410 may be used. This embodiment generally eliminates the flow of the process liquid 24 from the reactor vessel 20. This is particularly advantageous to the overall thermodynamics of the thermochemical beneficiation process for reasons we have discussed above. In addition, process liquid that has been extracted from the upper countercurrent reactor region is recirculated in a novel and efficient way from the fill liquid used to charge product lockhopper. This practice is also advantageous to the overall thermodynamics of the process.

The screw conveyor arrangement 410, with an auger 412 enclosed by an enclosure 414, is installed so as to penetrate the reactor internal side wall 25 in the lower portion 33 of the lower countercurrent reactor region 26. The shaft 415 of the auger 412 is hollow, with a relatively large diameter. This relatively large diameter enhances the beam stiffness of the auger 412. That is, generally the larger the diameter, the stronger or stiffer is the auger shaft 415. The auger 412, located within the enclosure 414, is inserted through a solids discharge opening 416 in the reactor internal side wall 25 and is positioned such that the exit opening 420 allows for the expulsion of both solids and liquid during operation.

A first end 422 of the auger 412 is supported by a bearing 425 at the reactor vessel internal side wall 25 at a location opposite the point of entrance of the screw conveyor 410. Solids and process liquid are transferred by rotational motion of the auger 412, out of the densely packed bed of carbonaceous solids 22, i.e., the submerged solids 84, within the reactor vessel 20. For solids with portions of relatively large particle sizes, it is preferable to have a serrated edge 432 at or near a point at which the extraction auger 415 exits the reactor vessel 20 and enters the solids discharge opening 416. This edge 432 (similarly to analogous edges in the embodiments of FIGS. 6 and 7) advantageously shears some of the larger solid particles and inhibits jamming of the auger 412. It may also be advantageous to provide a drive motor 434, which is attached to the auger second end 436 and which has a reversing feature, in case some of the larger solid particles are relatively hard, as would be the case when stones are present along with the coal.

The auger 412 needs to be of a length that is sufficient to extract the beneficiated solids from the reactor vessel 20 and convey the mixture of solids and liquids to a convenient location for the product lockhopper 440. The solids 22 and a portion of the process liquid 24, upon approach of the second end 436 of the completely enclosed screw conveyor 410, are discharged through the exit opening 420. This discharging is aided by forces from a combination of gravity and flush liquid (from the line 441). The solids/liquids are discharged into the product lockhopper 440, preferably into an arrangement of a plurality of the product lockhoppers 440 with a toggling tripper 442 to direct the flow of the material. This method is superior to simple gravity settling, in that it provides a convective conveyance of the solid particles downward towards the product lockhopper 440, which greatly accelerates the throughput.

The flush liquid directed through the line 441 is obtained from the lockhopper 440, which was charged with liquid before initiation of the process. The flush liquid in line 441 is forced from the product lockhopper 440 by a relatively low total developed head pressure, high volume pump 443. The pump 443 may be an encapsulated pump, or any other suitable pump. The rate of removal of nonsolids bearing the flush liquid directed through line 441, is preferably commensurate with the rate of arrival of solids from the screw conveyor 410, and establishes a convective circulation where the solids 22 are more rapidly conveyed downward into the product lockhopper 440 than by gravity settling alone.

The pump 443 used to extract flush liquid from the product lockhopper 440, is protected by a screen 446 of sufficient size and fineness to operate for at least one cycle. The screen 446 is cleared of solid contaminating material each cycle by a backflushing action caused by the discharge upon depressurization of a small accumulator 450. That is, the small accumulator 450, a device which stores energy, usually through the compression of a suitable gas, often air, contained in a suitable container, often, though not necessarily, includes an orifice in communication with line 441. The accumulator 450 normally exists at the relatively high pressure of the screw conveyor 410 and lockhoppers 440. When the lockhopper is depressurized to release material to the ambient pressure conditions outside, the accumulator depressurizes as well, forcing a small amount of process liquid back along line 441 (which forces back flushing action of screen 446). Flow along the rest of line 441 is made not possible during this operation by either a single direction valve (a check valve 451) or other suitable means of positive flow control as currently exists. The check valve is placed between the juncture of the accumulator with line 441, and the suction of the pump 443.

During the operation of this solids discharging arrangement, the flush liquid, which is directed through line 441, is preferably removed from the product lockhopper 440 at a rate commensurate with the rate of arrival of the solids. Furthermore, a portion of the flush liquid, upon combining with the solids/liquids in the screw conveyor arrangement and passing through exit opening 420, is partitioned into a return liquid chamber 452 defined by a baffle 453. The rotational motion of the auger 412 displaces a relatively incompressible volume of the solids/liquids towards the exit opening 420. This action is met either by an increase in pressure at the exit opening 420 relative to the pressure at the solids discharge opening 416, or by a displacement of an equal volume liquid elsewhere, or a combination of both. The arrival of the relatively incompressible volume of the solids/liquids is generally offset by a volume of liquid, e.g., water, displaced first from the product lockhopper 440, then into the return liquid chamber 452, then through the ports 455 in the second end 436 of the hollow auger shaft 415, through the egress ports 457 at the first end 422 of the auger shaft 415, and into the reactor vessel 20, where, as will be shown elsewhere in this description, the lockhopper flush liquid of the line 441 originated.

In certain circumstances, it is desirable to construct a loose collar 460 around the egress ports 457 and, furthermore, to provide a return liquid pipe 462. The return liquid pipe 462 shunts the liquid that has been transported through the auger shaft 415 away from the vicinity of the extraction auger 412. This arrangement has at least two desirable features. First, the liquid shunted through the pipe 462 may be directed away from the extraction auger 412, which allows the solids to attain the greatest settling density for efficient extraction. Second, by providing the return liquid pipe 462 designed with a simple downward turn of the pipe exit end 464 with a screen filter 465 attached thereto, the occurrence of solid particles entering the egress ports 457 can generally be reduced.

The displacement of the liquid in the lockhopper 440 is met by a nearly equal displacement of the discharged volume of the solids/liquids. This latter volume, however, is discharged at a rate that is slightly higher due to the presence of the additional force provided by the flush liquid of the line 441. The differential is accommodated by the flow of the process liquid and the solids, along with flush liquid, into the return liquid chamber 452, as stated above. By appropriate design of the chamber 452 and the baffle 453, the flow velocity of the liquids/solids therein is low enough to permit a settling of all but very small solid particles. Thus, generally particulate free liquid will enter the hollow auger shaft 415 and return to the reactor vessel 20 under pressure developed by the delivery of the solids and the process liquid by the screw conveyor arrangement 410.

The entry of more process liquid at the lockhopper 440, during one complete cycle, than is removed will lead to a net displacement of liquid in the reactor vessel 20 in the upward direction, rather than towards the screw conveyor 410, a thermodynamically desirable practice. That is, as mentioned above, the lockhopper is charged at the initiation of the process. The charging source is extracted from the slightly pressurized circulating process liquid.

The continuous flow nature of the screw conveyor 410 is augmented by providing more than one product lockhopper 440 per screw conveyor. Although this is not necessary to the performance of the apparatus as described, adding more than one lockhopper improves process throughput and avoids the tendency of the solids flow to begin encroaching into the return liquid chamber 452. By synchronizing the operation of the lockhoppers so that one is always prepared to accept a charge of solids by the end of the fill cycle of another lockhopper, continuous extraction of solids can be achieved, and the rotational speed of the screw conveyor can be operated at a steady state, dependent upon the desired rate of extraction. Furthermore, if a large solid particle jams the screw conveyor 410 during operation, causing the drive motor 434 to go into the reverse direction mode of operation, the filling cycle of the lockhoppers can be interrupted by appropriate control logic, and reverse flow into the hollow auger 412 will occur to balance the pressure differential developed.

Hybrid Process of Hydrothermal Reforming and Selective Oil Agglomeration

As stated previously, a preferred embodiment of the present invention incorporates a combined process of hydrothermal reforming, oil agglomeration, and low temperature drying. The advantages of this combination will become apparent in the following discussion.

As had been shown in FIG. 3, the segregation of the solid material between large and small particles may occur right after discharge from the product hydraulic lockhoppers used in the hydrothermal reforming process. Furthermore, the product lockhoppers may discharge directly onto a screen conveyor. If the oil agglomeration process is tolerant of process liquid, e.g., water, the fines with a particle size of less than about ⅛ inch (3 mm) could be washed through the screen with process waste liquid and hydraulically conveyed to the oil agglomeration tanks. If the oil agglomeration process is not tolerant of the process liquid, the fines could be separated from the process liquid stream by hydrocyclones and vacuum screen drying, or simply by fine screen filtering, prior to transport to the oil agglomeration process. It is noted, however, that the separation of the solid material between large and small particles can occur wet, upon discharge from the hydraulic lockhoppers.

The principle of selective oil agglomeration has been studied, and was described in 1922 by W. E. Trent (U.S. Pat. No. 1,420,164). Since then a number of individual research and development efforts have resulted in refinements and improvements (See, for example, U.S. Pat. Nos. 4,726,810; 3,957,456; 4,153,419). In the process, a coal/water slurry under agitation is mixed with a relatively small quantity of liquid hydrocarbon. The liquid hydrocarbon acts as a bridging liquid allowing the coal particles to tend to agglomerate. The different variations of the oil agglomeration process differ mainly in the type of agitation used to disperse the oil, wet the coal surface, and agglomerate the coal particles; the type and quantity of oil used; and, the separation and subsequent treatment of the product.

The use of oil agglomeration as a process element in preferred embodiments of the present systems and processes is advantageous. In addition, a valuable synergy exists between the hydrothermal reforming and oil agglomeration process elements. Oil agglomeration provides, for example, the following value to the end product:

1. Elimination of fines. The agglomeration of the fines fraction of the carbonaceous material generally reduces a prime source of handling problems. A product with the fine fraction agglomerated exhibits a greatly reduced tendency to have dusting and windage losses, freezing problems in the winter, and/or sludge problems when wet.

2. Efficient elimination of surface moisture associated with the fines. Due to the high surface area of the fine particle-sized fractions, i.e., "fines," and the large amount of inherent volume associated with the these fractions, moisture has a tendency to collect in the fines in a disproportionate amount. It then is difficult to remove. Oil agglomeration removes the moisture associated with the fine particle-sized fractions by replacement with another hydrocarbon, not by evaporative means. As a result, the process is energy efficient.

3. Removal of ash and pyrites. As carbonaceous material such as coal breaks down from large particles to small particles, it has a tendency to break along grains with relatively high concentrations of mineral matter, i.e., ash. As a result, the fines fraction of the material often has an accumulation of ash that is greater in proportion than the average amount found in the raw material, e.g., unprocessed coal. The ability of the oil agglomeration process to effectively wash away a relatively large portion of this liberated mineral matter increases the fuel quality of the agglomerates. Furthermore, this reduces the sulfur content of the overall fuel product, as sulfur-containing minerals are often part of the liberated ash.

The combination of these two process elements (hydrothermal reforming and oil agglomeration) is preferred for an economic low rank coal beneficiation process. One reason for this is that oil agglomeration alone, with the attributes described above, will not work effectively on carbonaceous materials such as raw low rank coals. Although it is possible to use the oil agglomeration process on most carbonaceous substances, the conditions under which agglomeration generally occurs hinders the ability of the process to selectively separate out mineral matter. It is generally found that the lower the ash content of a fuel, the better the quality of the fuel. Thus, raw low rank coal is advantageously first hydrothermally reformed, for a later oil agglomeration to work effectively. Furthermore, although hydrothermal reforming produces an advantageously beneficiated product for a variety of carbonaceous materials, there are certain circumstances under which the hydrothermal reforming system is preferably and advantageously combined with the oil agglomeration process. For example, with the beneficiation of materials with large fractions of relatively small particle size solids, advantage is realized by combining oil agglomeration and hydrothermal reforming.

Low Temperature Drying and Storage

In certain preferred embodiments low temperature drying is applied to the coarse hydrothermally reformed product and the oil agglomerates. This can be done either separately, or with the two fractions combined together. Following hydrothermal reforming, the equilibrium moisture content of the carbonaceous solids has been permanently reduced. The beneficiated product, however, has not yet fully reached this lower equilibrium moisture content. Low temperature drying is thus preferably applied to efficiently allow the coal product to fully attain the quality necessary for an export quality product, i.e., the lowest moisture content practical. Low temperature drying may be applied in several ways or combination of ways. For example, centrifuging, thermal drying, and aerated storage are considered potential means. The preferred embodiment comprises: centrifuging the wet coarse product only; storing both the coarse and agglomerates in the same storage vessel; and using forced aeration of the storage vessel with air heated to a nominal value of about 150° F. (66° C.). This heated air is preferably from the hydrothermal reforming plant or nearby plants. The air exiting the forced aeration process is preferably recirculated and used as combustion air in on-site or nearby furnaces, or in other suitable means of disposition.

Waste Water Treatment

Since the hydrothermal reforming process and other drying processes remove water from the carbonaceous materials as a liquid, a substantial amount of water is produced as a by-product. Although conventional waste-water-treatment (WWT) processes are useable, advanced membrane separation, powdered activated carbon treatment, and biological treatment technologies are preferable.

EXAMPLE I

Process Description for Upgrading North Dakota Lignite

Figure 9A:
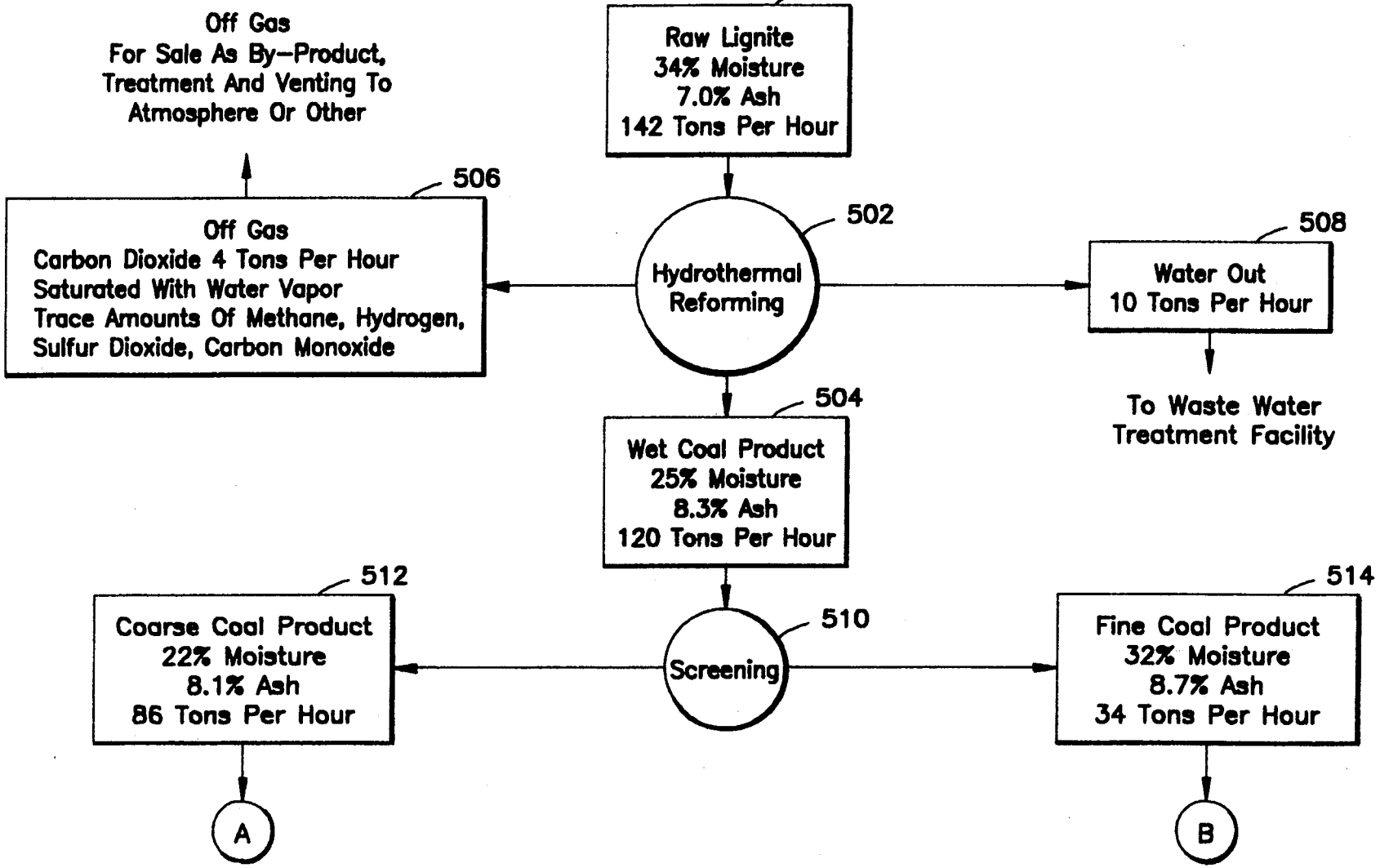
FIG. 9A is a flow chart of a portion of an overall process involving selected methods of the present invention used for upgrading certain lignite material (see Example I).
Figure 9B:
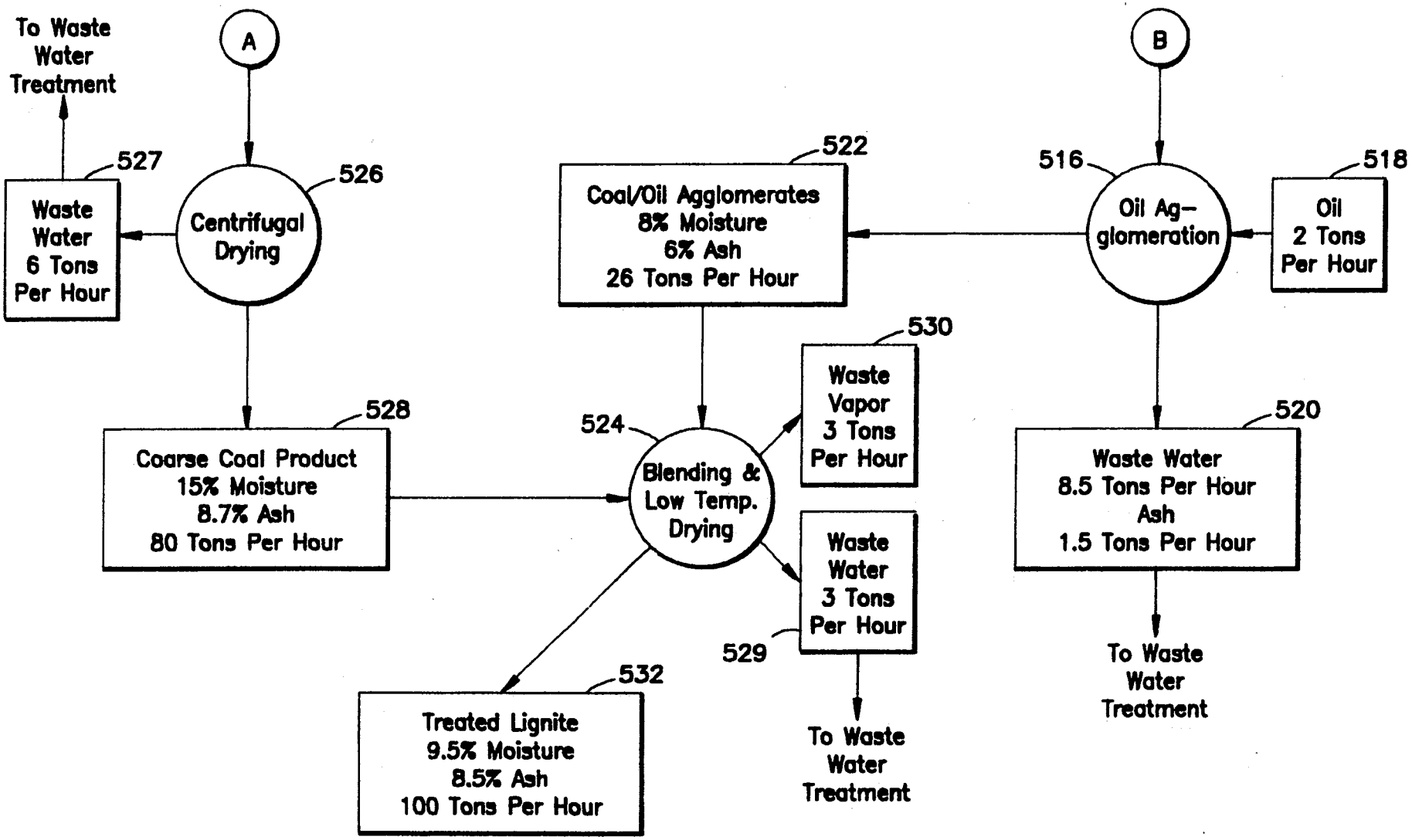
FIG. 9B is a flow chart of follow-up steps to the process described by FIG. 9A.

A low-rank coal beneficiation process based on the treatment of a hypothetical example of a one hundred ton-per-hour output is described. A simplified flow chart of this hypothetical example is shown in FIGS. 9A and 9B (FIG. 9B following from FIG. 9A, e.g., "A" in FIG. 9A follows to "A" in FIG. 9B). The mass balance for the major constituents is also described; however, no attempt has been made to quantify the minor process constituents, such as sodium content, sulfur, or the minor losses that occur as a natural result of the operation of most real process elements. In other words, the mass balance closure is on only the gross flow of the major constituents. The process is based on the up-grading of a generic North Dakota lignite, but is not limited to this coal. Other low-rank coals are expected to be candidates for use with this process. The quantities represented here are provided as typical of the process in general.

Raw lignite is mined and crushed to a nominal three-inch-by-zero (3×0) size distribution. The as-mined lignite typically has the following composition by weight (all numbers in percent) (total hydrocarbon=47%, as defined by carbon and hydrogen %):

| Carbon | Hydrogen | Oxygen | Water | Ash |
|---|---|---|---|---|
| 44 | 3 | 12 | 34 | 7 |

If the lignite is represented as a "macro-molecule" in which the ash is represented simply as silica ($SiO_2$) its composition could be written as: $[C_{54}H_{47}O_{11}\bullet 27(H_2O)+1.7SiO_2]$. This format will be used throughout the description which follows.

Hydrothermal Reforming

Referring to FIG. 9A, raw lignite, at 500, which has been crushed to a nominal 3×0 size distribution, is fed into the hydrothermal reforming vessel, at 502, at a rate of 142 tons per hour. After processing, the wet reformed lignite is removed from the reforming vessel. The wet reformed lignite, at 504, typically has 25% total moisture, 8.5% inherent moisture, and its oxygen content has been reduced by 30%. The wet reformed lignite is removed from the reforming vessel at a rate of 120 tons per hour. In order to maintain equilibrium in the reforming vessel, off-gas, i.e., process gases, at 506, and process water, at 508, are removed from the reforming vessel. The off-gas is typically primarily carbon dioxide ($CO_2$), saturated with water vapor, and contains small amounts of light hydrocarbons, carbon monoxide (CO), and sulfur dioxide ($SO_2$). The process gases are removed at a rate of 4 tons per hour. Process water, produced as a by-product of the reforming reaction is removed from the reactor at a rate of 18 tons per hour. The reaction can be expressed as:

$$194[C_{54}H_{47}O_{11}.27(H_2O) + 1.7SiO_2] \longrightarrow 194[C_{53}H_{47}O_9.4.5(H_2O) + 1.7SiO_2] + 194CO_2 + 2423H_2O^{surface} + 1939H_2O^{free} \quad (1)$$

Water is expressed twice in the reaction (1) to describe the water associated with the surface moisture of the wet coal product as separate from the free water produced in the system. Free water is further defined as water which will drain or flow freely from the process and its product. The process gases are vented from the reactor vessel under controlled conditions and the free water is removed by methods described previously.

Wet Coal Product Screening

The wet coal product from the reforming reactor vessel is screened, at 510, into two size distributions: coarse at 512, and fine at 514. Typically, the split point is at a size of approximately ⅛ inch (3 mm). With this "split point" approximately one fourth of the total processed wet coal product flows to the fine coal stream. The method used to screen the coal is existing commercially available technology. Wet traveling screens with sprays are an example. The coarse stream typically flows at a rate of about 86 tons per hour, the rate of the fine stream is about 34 tons per hour.

Two differences are noticed in the average composition of the two streams. The coarse stream has a slightly lower total moisture content than the fine stream due to its lower average surface area to volume ratio. In addition, the fine coal stream has a somewhat increased average ash content due to a concentration of mineral matter (ash). The increased ash content is not due to an actual increase in the inherent mineral content of the coal, but to the inclusion within the aggregate fine coal stream of small mineral grains liberated in the fracturing of larger coal particles. This process element may be represented by the following reaction:

$$194[C_{53}H_{47}O_9.4.5(H_2O) + 1.7SiO_2] \longrightarrow \{145\,[C_{53}H_{47}O_9.4.5(H_2O) + 1.6SiO_2] + 1454H_2O\}^{coarse} + \{49[C_{53}H_{47}O_9.4.5(H_2O) + 2.0SiO_2] + 969H_2O\}^{fine} \quad (2)$$

Selective Oil Agglomeration

The fine wet coal product, at 514 (in FIG. 9A), enters into the oil agglomeration process element, at 516 (in FIG. 9B along arrow "B"), at a rate of about 34 tons per hour. Oil (in this case represented as $C_{12}H_{12}$), at 518, is added to the agglomerators at a rate of 2 tons per hour. The wash slurry stream created by the oil agglomeration process leaves the process at a rate of 10 tons per hour (8.5 tph water, 1.5 tph ash), at 520, and is directed to the waste water treatment facility. The coal/oil agglomerates, at 522, having been stripped of most of their surface moisture by the physical replacement of oil-for-water, have 8% total moisture and 6% ash. Since part of the ash is sulfur-containing pyrites, the sulfur content of the agglomerates is typically less than the average sulfur content of the feed coal. The reaction of the oil agglomeration process element can be represented as follows:

$$49[C_{53}H_{47}O_9.4.5(H_2O) + 2.0SiO_2] + 969H_2O + 27C_{12}H_{12} \longrightarrow \{49[C_{53}H_{47}O_9.4.5(H_2O) + 1.0SiO_2] + 27C_{12}H_{12} + 10H_2O\}^{agglomerates} + \{959H_2O + 4.9SiO_2\}^{waste\ stream} \quad (3)$$

The coal/oil agglomerates are directed to the combined low-temperature drying/storage area, at 524, where they are blended with the coarse coal for eventual product out for sale.

Centrifugal Drying

Commercially available centrifugal dryers, 526 (in FIG. 9B), are used to "spin dry" the coarse coal fraction (shown in FIG. 9A). This process element simply removes surface moisture from the coarse coal particles, from a total moisture content of 22% down to 15%. The wet coal stream enters the centrifugal dryers at a rate of 86 tons per hour, leaves at a rate of 80 tons per hour, with a process water stream of 6 tons per hour, at 527, reporting to the waste water treatment facility. This process element can be represented by the following reaction:

$$145[C_{53}H_{47}O_9.4.5(H_2O) + 1.6SiO_2] + 1454H_2O \longrightarrow \{145[C_{53}H_{47}O_9.4.5(H_2O) + 1.6SiO_2] + 774H_2O\} + 680H_2O \quad (4)$$

Blending and Low-Temperature Drying

The coarse coal product from the centrifugal dryers, at 528, is blended with the coal/oil agglomerates, at 524, and stored in a product out silo. A separate drying process element prior to storage may also be possible, however, this example assumes that the low-temperature drying occurs in the storage silo. It is anticipated that a relatively low-temperature drying gas (~150° F., i.e., 60° C.), likely waste heat from a nearby combustion process, will be forced into the top of the specially constructed storage silo. This low level temperature gas will be forced through the coal bed in a downward direction at a relatively slow rate. Moist process gas and water are collected at the bottom and are removed. This silo will maintain the product at a sufficiently elevated temperature for the product to essentially approach its equilibrium moisture content, or below it. The final moisture removed from the product will be partly evaporated and partly drained off the bottom of the storage silo. After completing this incubation period, the final product is achieved. The reaction can be expressed as:

$$145[C_{53}H_{47}O_9.4.5(H_2O) + 1.6SiO_2] + 774H_2O + \text{agglomerates} \longrightarrow \{194\,[C_{53}H_{47}O_9.4.5(H_2O) + 281SiO_2] + 27C_{12}H_{12} + 183H_2O\}^{product} + (301H_2O)_{liquid} + (300H_2O)_{vapor} \quad (5)$$

The three tons per hour of liquid water, at 529, produced reports to the waste water treatment plant and, the 3 tons per hour of vapor, at 530, produced escapes with the drying gas. The rate of drying produced by this process element is expected to be nonlinear, thus the production rates of vapor and liquid are represented as average over the operation of the facility.

Final Product & Waste Water Treatment Facility

The final product, at 532, has an aggregate typical composition of (quantities in percent):

| Carbon | Hydrogen | Oxygen | Water | Ash |
|---|---|---|---|---|
| 63 | 5 | 14 | 9.5 | 8.5 |

The product will be produced at a rate of 100 tons per hour. This represents a significant improvement over the raw lignite feedstock. In addition, the process elements are inherently efficient, making the overall process very energy efficient.

The cumulative quantity of the separate feedstocks reporting to the commercially available waste water treatment facility is 35.5 tons per hour. After treatment, this water can be sold as a by-product.

Solids Feed System: Feed Lockhopper

Conventional hydraulic lockhoppers, i.e., liquid-filled lockhoppers, came into use to overcome some of the disadvantages of nonhydraulic lockhoppers, e.g., gas-filled lockhoppers. For example, conventional hydraulic lockhoppers are safer to use. Because gases are compressible volumes, they store appreciable energy when pressurized. Liquids, however, store little energy upon pressurization because they are relatively noncompressible. During the filling and pressurization cycle of a lockhopper, the lockhopper is subjected to repeated cyclical stresses, which can ultimately cause mechanical failure in one or more components. As a result, filling the lockhopper with liquid and pressurizing it results in relatively little danger upon the failure of a lockhopper component because little energy is released and failures do not exhibit explosive behavior. Conversely, gas pressurized lockhoppers can fail explosively due to the large energy stored in the compressed gas. Hydraulic lockhoppers also operate more efficiently. It is generally quicker to fill a storage volume with a liquid and raise its pressure than to accomplish the same with a gas.

Conventional hydraulic lockhoppers, however, often use liquid filling in both the pressurization and the depressurization cycles of their operation. That is, after discharge of the solids feed material into the reactor vessel, the lockhopper is typically filled with a liquid at the same high pressure as that of the reactor vessel. The lockhopper is then sealed and depressurized. The solids are charged into the liquid filled lockhopper storage volume, or the liquid is emptied and then filled with solids before refilling with liquid. However, failures almost always occur during the pressurization part of the cycle.

A preferred solids feed system and method of the invention takes advantage of these facts by pressurizing as a hydraulic lockhopper, but depressurizing as a gas-filled lockhopper, charging with solids, and then pressurizing with liquid. Advantage with respect to speed results, at least in part, from the fact that solids do not have to be charged into a liquid filled lockhopper (a relatively slow process), and the fact that a liquid-filled lockhopper does not have to be drained, only to be refilled again after charging it with solids. Furthermore, the preferred solids feed system of the invention is used to advantage with the reactor of the invention because of the presence of the gas-filled region of the reactor vessel. That is, upon charging conventional reactors with feed solids from a conventional hydraulic lockhopper, liquid is typically displaced into the lockhopper from the reactor, whereas in the system of the present invention, gas is displaced into the lockhopper from the gas receiving region of the reactor.

The solids feed system 120 described above and shown in FIG. 5 can preferably and advantageously use a modified version of a feed hydraulic lockhopper 122 with modified and advantageous versions of the inlet valve arrangement 124 and the outlet valve arrangement 129. The modified version is preferable because it reduces energy storage during the compression cycle and reduces the cost of maintenance, while increasing the cycling speed, i.e., the speed at which the reactor is charged with feed solids. The modified version also interfaces with the balance of the reactor system in a desirable manner. A preferred embodiment of the modified version of the solids feed system is shown in FIG. 10; with two stages of operation shown in FIGS. 11 and 12. The reactor vessel in FIGS. 10–12 can be a vessel 20 as described above, and shown in FIG. 4, but this is not required.

Figure 10:
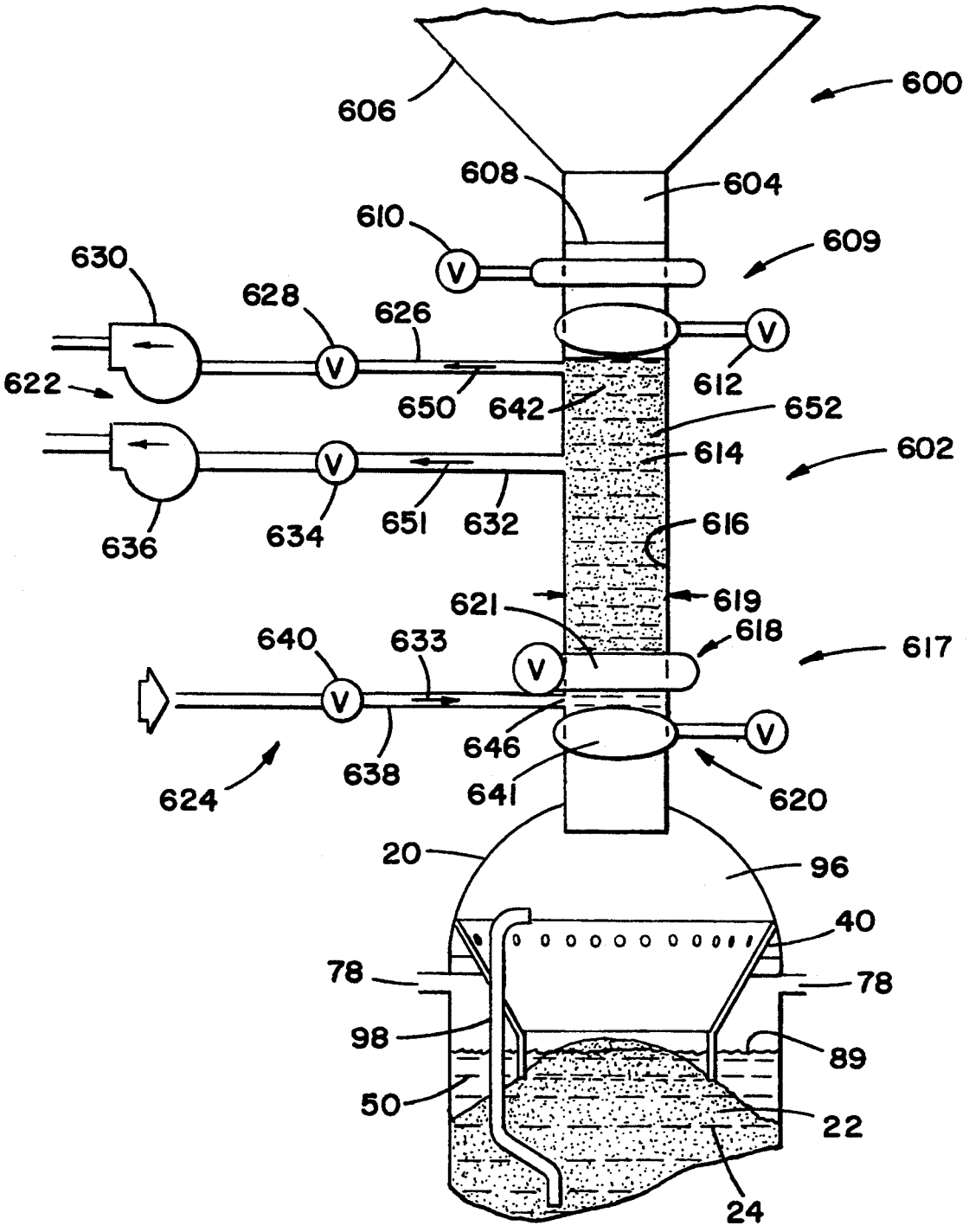
FIG. 10 is a schematic drawing of a solids feed system.
Figure 11:
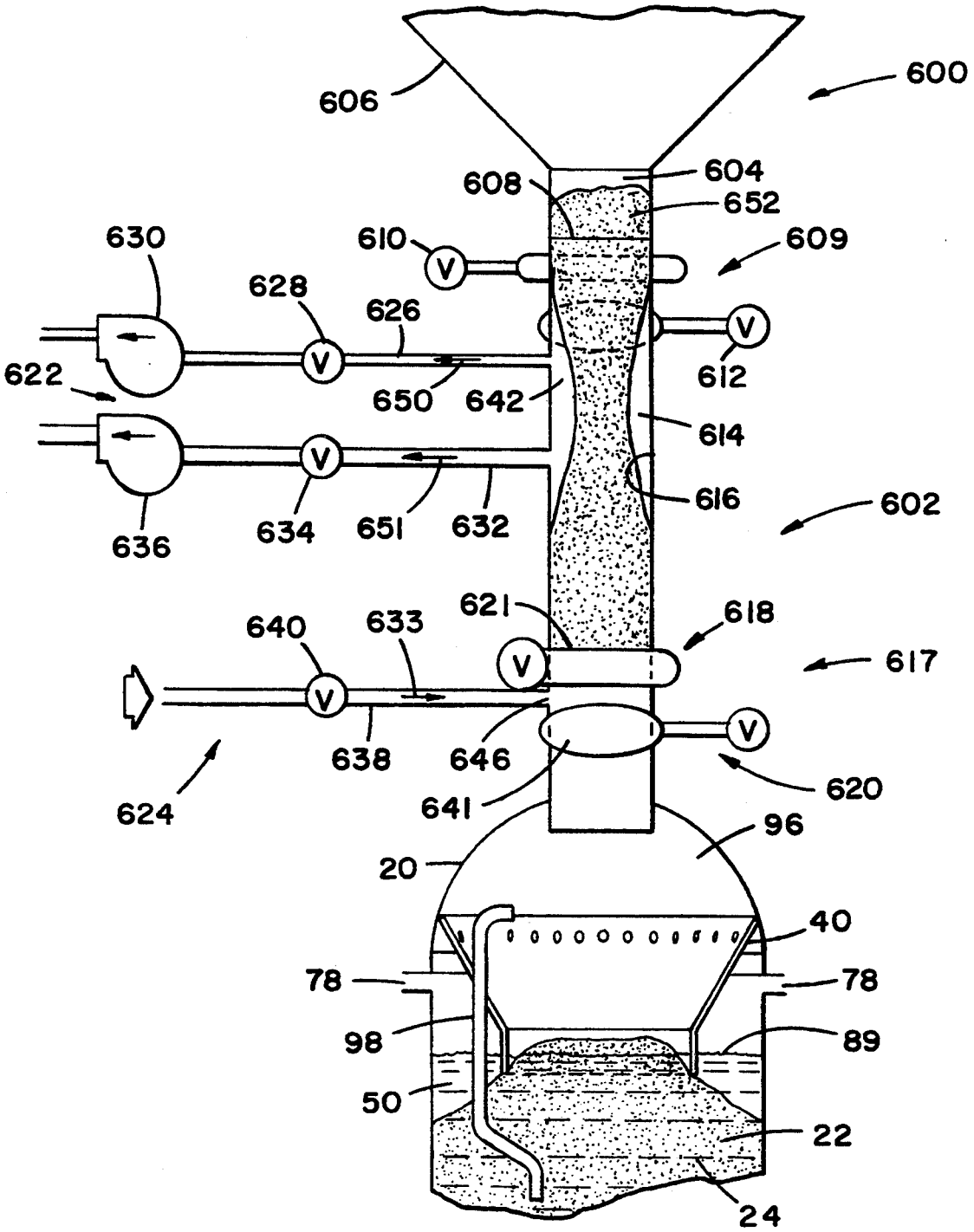
FIG. 11 is a schematic drawing of a solids feed system according to FIG. 10 shown in the lockhopper charging stage of operation.
Figure 12:
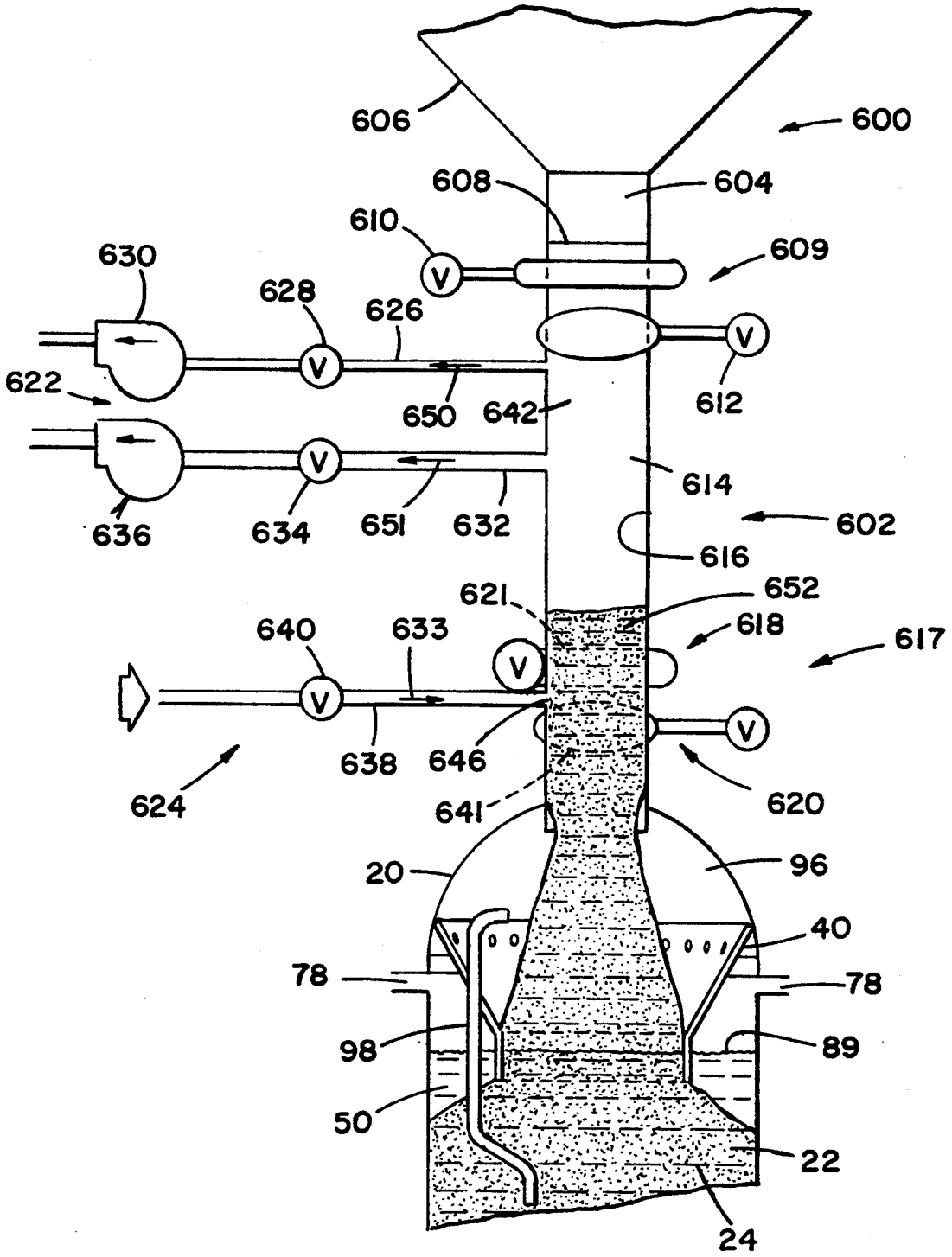
FIG. 12 is a schematic drawing of a solids feed system according to FIG. 10 shown in the lockhopper discharging, i.e., reactor charging, stage of operation.

In general, the assembly shown in FIGS. 10–12 includes a reactor vessel 20 adapted to confine a downwardly moving bed of solids and a countercurrent flow of process liquid and gas, means for operating the reactor vessel at a pressure of at least a first operating pressure, and a solids feed system 600 for charging the reactor vessel with feed solids. The solids feed system 600 consists of a feed lockhopper 602, to which is directed the solids, e.g., carbonaceous solids, through a material feed pipe 604 from a storage bunker 606 (not shown in its entirety) to the entrance 608 of the lockhopper 602. A modified inlet valve arrangement 609, i.e., a first valve arrangement, consists of an upper material flow valve 610 and an upper pressure seal valve 612. The lockhopper upper material flow valve 610, near the entrance 608 of the lockhopper 602, in combination with the upper pressure seal valve 612 delivers feed solids from the material feed pipe 604 into a lockhopper storage receptacle 614. The upper material flow valve 610 is not required to be a pressure valve, and is preferably and typically made from relatively inexpensive materials. An example of a suitable upper material flow valve 610 is a pneumatically operated gate valve made from mild steel. The upper material flow valve 610 is operably positioned so as to protect the upper pressure seal valve 612 from direct communication or contact with feed solids. This does not mean that no feed solids contact the upper pressure seal valve 612, just that a major portion of the feed solids do not come into contact with it and thereby damage it.

The upper pressure seal valve 612 is designed to seal the reactor vessel 20, which is at an operating pressure thereof (about 300 to about 2300 psi) from a second lower pressure of the feed pipe 604, which is typically at or near atmospheric pressure. It will be seen from the description of the lockhopper 602 during operation that the storage receptacle 614 is at the operating pressure of the reactor and then, alternately, at a second, lower, pressure such as that of ambient conditions. A valve of existing art can be used for the purpose of sealing the pressure differential between the reactor operating pressure and the second pressure. An alloy ball valve, constructed for rough duty, is preferred for this valve and its designed use.

The storage receptacle 614 is constrained by an internal side wall 616 of the lockhopper 602, the upper pressure seal valve 612, and an outlet valve arrangement 617, specifically a lower material flow valve 618 of the outlet valve arrangement 617. The shape of the lockhopper storage receptacle 614 depends upon the flow characteristics of the material. A suitable and preferable shape of the storage receptacle 614 for a material such as coal is substantially cylindrical. The lockhopper storage receptacle 614 is preferably of the same internal diameter 619 as that of the material feed pipe 604, and of a length determined by the flow capacities of the reactor 20.

Material flow from the lockhopper storage receptacle 614 is controlled by the outlet valve arrangement 617, which consists of the lower material flow valve 618 and a lower pressure seal valve 620. The lower material flow valve 618 is preferably designed such that the valve body 621 can withstand the pressure differential between the higher operating pressure of the reactor vessel 20 and the lower pressure of outside ambient conditions. It is not necessary, however, for the lower material flow valve 618 to control pressure across its entire valve seal. This is because the lower material flow valve 618 is generally intended only to control the flow of solid material from the lockhopper storage receptacle 614 into the reactor vessel 20. Hence, lower material flow valve 618 can be made from relatively inexpensive materials such as mild steel. An example of a suitable valve for the lower flow valve 618 is a pneumatically operated trap-door type valve. The lower pressure seal valve 620, however, must control pressure across its entire valve seal because it seals off the pressure differential between the reactor vessel operating pressure and the lower, second, pressure of the storage receptacle 614 when it is in its depressurized state, e.g., at or near atmospheric pressure. The lower pressure seal valve 620 is preferably of a similar construction to that of the upper pressure seal valve 612. As with the first valve arrangement 609, the lower material flow valve 618 of the lower, i.e., second, valve arrangement 617 is operably positioned so as to protect the lower pressure seal valve 620 from direct communication or contact with feed solids. As with the upper pressure seal valve 612, this means that a major portion of the feed solids are prevented from coming into contact with the lower pressure seal valve 620 and damaging it.

The feed lockhopper 602 also consists of a venting system 622 and filling system 624. The venting system 622 consists of a vent line 626, a vent line valve 628, and preferably, an extraction device 630. A preferred embodiment of the venting system 622 consists of a secondary vent line 632, a secondary vent line valve 634, and an extraction device 636 for the secondary vent line 632. Although it is not a requirement that a plurality of venting lines be used, it is advantageous to have at least two venting lines, at least in part because of the increased rate of the solids feeding process due to more rapid depressurization of the lockhopper receptacle 614. The filling system 624 consists of a fill line 638 and a fill line valve 640. The function and operation of the venting system 622 and the filling system 624 are discussed in greater detail below.

The operation of the solids feed system 600 during one cycle is described with reference to FIGS. 10, 11, and 12. The charging stage of the lockhopper 602 is shown in FIG. 11 and the discharging stage, i.e., the stage in which the solids are discharged from the lockhopper 602 and charged into the reactor 20 is shown in FIG. 12. FIG. 10 shows the stage of operation after the lockhopper storage receptacle 614 has been charged with solids and pressurized with liquid, but before the solids have been transferred to the reactor vessel 20.

In this description of operation, initially, i.e., prior to the lockhopper charging stage, the material to be fed into the higher pressure zone of the reactor vessel 20 rests in the material feed pipe 604 above the lockhopper upper material flow valve 610, which is closed. The upper pressure seal valve 612 is also closed at the start of the cycle. The lockhopper storage receptacle 614 is generally at the pressure of the reactor vessel 20, and contains gases inherent to the process gas receiving region 96, i.e., the upper part of the reactor vessel 20. During this stage of operation, the storage receptacle 614 is in direct communication with the reactor vessel 20, with the delivery of the feed solids into the reactor vessel 20 having just been completed. Thus, the lower material flow valve 618 is open, as is the lower pressure seal valve 620. This orientation of the valves 610, 612, 618, 620 is the same as is shown in FIG. 12.

The lockhopper storage receptacle 614 of the lockhopper 602 is then sealed off from the reactor vessel 20 by closing the outlet valve arrangement 617 for the lockhopper charging stage of the operation. The lower material flow valve 618 is closed first. A purging spray (not shown in FIGS. 10–12) is preferably activated to clean the valve seat of the lower material flow valve 618. Following seating of the lower material flow valve 618, the lower pressure seal valve 620 is closed, and a purging spray is again activated to advantage to clean the valve seat of the lower pressure seal valve 620. The lower pressure seal valve 620 is closed after the lower material flow valve 618 in an effort to prevent any residual solid material in the storage receptacle 614 from impacting the valve body 641 of the lower pressure seal valve 620. Following this, the pressure in the storage receptacle 614 is reduced by opening the vent line valve 628. The vent line 626 is located in the upper portion 642 of the lockhopper storage receptacle 614, and is of a relatively small diameter tubing designed for the passage of gases and liquids, when desired, along the direction of arrow 650 out of the lockhopper storage receptacle 614. In order to reduce gaseous venting time further, it is preferable and advantageous to utilize the secondary venting line 632. The secondary venting line 632 is preferably of slightly larger diameter than the venting line 626. It typically and advantageously penetrates the internal side wall 616 of the storage receptacle 614 near the first venting line 626 and is designed for the passage of gases and liquids along the direction of arrow 651 out of the lockhopper storage receptacle 614.

During venting, when the storage receptacle 614 has reached a predetermined intermediate pressure between that when the cycle was started, i.e., when the storage receptacle 614 was at or near an operating pressure of the reactor 20, and its ending lower pressure, the secondary venting valve 634 can be opened for advantage. Venting can also be aided by extraction devices 630 and 636. Examples of such a device include a blower, or eductor. The secondary venting line 632 is preferably used to lower the pressure in the storage receptacle 614 below that of either ambient pressure or the pressure in the material feed pipe 604, and/or to accelerate the rate of gas venting. The gases vented from the lockhopper storage receptacle 614 are preferably discharged into the process gas stream (described in greater detail above) and/or back into the reactor vessel 20 to control volume and pressure. After the venting process is complete, the secondary vent line 632 is closed, if it was used. The first vent line 626 is left open; however, the destination of the material, which is removed from the storage receptacle 614 along the direction of arrow 650, is preferably switched from the reactor process gas stream to a sump for waste process liquid (not shown in FIGS. 10–12).

The feed lockhopper 602 is then charged with solid feed material 652, e.g., carbonaceous solids, as shown in FIG. 11. The upper pressure seal valve 612 is opened completely. The lockhopper upper material flow valve 610 is opened for a predetermined length of time for charging and then closed. A controlled amount of solid feed material 652 falls into the lockhopper storage receptacle 614 as a result. The lockhopper storage receptacle 614 is filled with the solid feed material 652 to an extent such that a reasonable level is maintained below the upper pressure seal valve 612. An alternative method of charging the lockhopper storage receptacle 614 is to dump a controlled amount of solid feed 652 through the open upper material flow valve 610 using a belt feeder of conventional design (not shown in FIG. 11). The lockhopper storage receptacle 614 is then sealed off from the feed pipe 604 by closing first the upper material flow valve 610 and then the upper pressure seal valve 612.

The lockhopper storage receptacle 614 is then filled with liquid and pressurized using the filling system 624, i.e., through the fill line 638 by opening the fill line valve 640. A liquid, usually the process water from the reactor vessel 20, is introduced into the lockhopper 602 along the direction of arrow 633. When liquid begins to escape from the upper vent line 626, or when other suitable means of detecting the liquid level in the lockhopper storage receptacle 614 indicates the storage receptacle 614 is sufficiently charged with liquid, the vent line valve 628 is closed. The lockhopper storage receptacle 614 will then relatively quickly approach the operating pressure of the reactor vessel 20. Upon pressurization, the pressure in the storage receptacle 614 approximately equals the operating pressure of the reactor vessel minus the pressure of the vertical head between the upper level of the liquid/solids in storage receptacle 614 and an entry point 646 of the lockhopper fill line 638, plus an additional amount of pressure delivered by the process water pressurization pump (not shown in FIG. 10 but described above and shown in FIG. 5).

The entry point 646 of the fill line 630 can be either above or below the lower material flow valve 618. Alternatively, there may be a plurality of fill lines which could be above, below, or above and below the lower flow valve 618. The fill line 638 penetrates the lockhopper wall 616 slightly above the lower pressure seal valve 620 at the entry point 646. If the entry point 646 is below the lower material flow valve 618, it is desirable to provide some means of leakage of the liquid across the valve 618. Numerous well-known methods are known in the art for this.

Once the storage receptacle 614 has been pressurized, the lockhopper fill line 638 is closed and the situation exists as shown in FIG. 10. Then the lockhopper 602 is discharged (see FIG. 12). The lower pressure seal valve 620 is opened first, then the lower material flow valve 618 is opened. Process water spray (not shown), preferably from the same source of liquid as that provided through the lockhopper fill line 638, is activated to facilitate fluidizing the solid feed material 652 stored in the storage receptacle 614. The solids feed material 652 then drops into the reactor vessel 20. The spray is then turned off and the cycle is repeated.

In addition to the advantages listed above with respect to this solids feed system, another advantage is the use of additional, relatively inexpensive, valves to protect the pressure seal valves. The pressure seal valves, by necessity are expensive, and prone to high maintenance costs due to the need to maintain tight tolerances, and the opportunity for rapid wear. Damaging wear can occur as a result of solid particles being trapped between the sliding pressure sealing surfaces, thus resulting in looser clearances and unacceptable leakages. The rate of wear can be reduced by selective choice of alloys, which can provide for a harder surface. However, the use of a separate valve to segregate the feed material from contact with the pressure seal valve can substantially reduce the opportunity for particle entrapment upon sealing of the pressure valves.

Still another advantage is the use of reactor process liquid, which is already nearly at the pressure required by the lockhopper for equalization. This eliminates the need for pumps of high total developed head, and replaces it with a pump of much smaller requirements. The use of process liquid to fill the lockhoppers also eliminates the entrance of superfluous liquid into the reactor vessel, which improves the process thermodynamics, and reduces waste treatment costs, as discussed above.

It is to be understood that while certain embodiments of the present invention have been illustrated as described, the invention is not to be limited to the specific arrangements described and shown, except as according to the following claims.

What is claimed and desired to be secured by Letters Patent is as follows:

1. A process for thermochemical beneficiation of carbonaceous solids including a fraction of particles of a size of less than ¼ inch in diameter; said process including the steps of:

(a) feeding carbonaceous solids into a reactor vessel having:

(i) an internal sidewall defining a lower reaction region;

(ii) said lower region including a process liquid inlet port extending through the internal sidewall; and, an upper region including a process liquid outlet port extending through the internal sidewall;

(iii) a solids discharge opening in the reactor vessel lower region;

(iv) a retaining structure constructed and arranged to operably support a section of carbonaceous solids, within the reactor vessel, that is spaced from the reactor vessel outer sidewall with a freestanding liquids region therebetween; said retaining structure including an outer wall defining: an upper funnel portion; a lower ring; and, a bottom edge; wherein said freestanding liquids region is positioned between said lower ring and wherein said reactor vessel outer sidewall; said upper funnel portion is constructed and arranged to support carbonaceous solids therein;

(b) directing a flow of process liquid: into the process liquid inlet port; upwardly through the reactor vessel; into the freestanding liquids region; and, outwardly through the process liquid outlet port; said process liquid having an uppermost level;

(c) directing a downward flow of carbonaceous solids, including a fraction of carbonaceous particles having a size of less than ¼ inch in diameter, along a path countercurrent to the flow of process liquid; said step of directing a flow of carbonaceous solids including:

(i) charging the carbonaceous into the retaining structure, with: a portion of the carbonaceous solids retained above the uppermost level of the process liquid; and, with a portion of the carbonaceous solids spaced from the reactor vessel sidewall, with the retaining structure and the freestanding liquids region positioned between a portion of the carbonaceous solids and the reactor vessel sidewall; and, (ii) moving the carbonaceous solids downwardly from the retaining structure, through the reactor vessel and outwardly through the solids discharge opening; and, (d) beneficiating the carbonaceous solids as they move downwardly from the retaining structure to the solids discharge opening, by hydrothermal reforming at a temperature and pressure sufficient to achieve expulsion of surface and inherent water from the carbonaceous solids, including expulsion from the fraction of carbonaceous solids of less than ¼ inch in diameter, into the process liquid;

(e) and settling at particulates of less than ¼ inch in diameter from the process liquid in the freestanding liquids region.

2. A process according to claim 1 further including the steps of:

(a) continuously drawing, outwardly through the process liquid outlet port, at least a portion of liquid from the freestanding liquids region; and, (b) recirculating at least a portion of the liquid drawn from the freestanding liquids region into the reactor vessel process liquid inlet port as recirculated process liquid flow.

3. A process according to claim 1 wherein:

(a) said step of feeding carbonaceous solids into said reactor vessel further includes providing a process gas receiving region oriented above the freestanding liquids region; and, (b) said step of beneficiating further includes a step of directing process gases from a location submerged in the process liquid to the process gas receiving region.

4. A process according to claim 1 further including steps of:

(a) charging feed solids of carbonaceous solids including a fraction of less than about ¼ inches in diameter into the upper funnel portion of the retaining structure and into the portion of the carbonaceous solids retained above the uppermost level of the process liquid; said step of charging feed solids including charging from a feed lockhopper storage receptacle and including a step of displacing gas from the reactor vessel into the lockhopper storage receptacle;

(b) following said step of charging feed solids, venting gas from the storage receptacle to the atmosphere without opening the reactor vessel to the atmosphere;

(c) following said step of venting gas from the storage receptacle, charging the storage receptacle with feed solids at atmospheric pressure;

(d) following the step of charging the storage receptacle, pressurizing the storage receptacle, with liquid, to a pressure above atmospheric pressure and corresponding to a pressure within the reactor vessel; and, (e) repeating steps 65(*a*)–65(*d*) during said step of beneficiating, to provide a continuous flow of carbonaceous solids downwardly through the reactor vessel, during the process.

5. An apparatus system for use in beneficiating carbonaceous solids, said reactor arrangement comprising:

(a) a reactor vessel having:

(i) an internal sidewall defining a lower reaction region;

(ii) said lower region including a process liquid inlet port extending through the outer sidewall; and, an upper region including a process liquid outlet port extending through the internal sidewall defining a lower reactor region; and (iii) a solids discharge opening in the reactor vessel lower region;

(b) a retaining structure constructed and arranged to operably support a section of carbonaceous solids, within the reactor vessel, that is spaced from the reactor vessel sidewall; said retaining structure including an outer wall defining: an upper funnel portion; a lower ring; and a bottom edge; said retaining structure defining a volume within the reactor vessel for receiving freestanding liquids, wherein the volume for receiving freestanding liquids is positioned between the lower ring and wherein the reactor vessel outer sidewall; the upper funnel portion is positioned to support carbonaceous solids therein above an uppermost process liquid level, during use.

6. An apparatus system according to claim 5 further including:

(a) means for selectively feeding carbonaceous solids into said upper funnel portion of said retaining structure.

7. An apparatus system according to claim 5 further including:

(a) at least one shunt tube oriented to direct process gases from a location below the retaining structure to a location above the retaining structure.

8. An apparatus system according to claim 5 further including:

(a) means for selectively and continuously discharging beneficiated solids from the reactor vessel and through the solids discharge opening in the reactor vessel outer sidewall.

9. An apparatus system according to claim 8 wherein said means for selectively and continuously discharging beneficiated solids comprises at least one screw conveyor.

10. An apparatus system according to claim 9 wherein said at least one screw conveyor is sufficiently long, and narrow in cross-section, to allow direct discharge of carbonaceous solids from within said reactor vessel, when said reactor vessel is operated at a pressure greater than ambient, to a location at ambient pressure.

11. An apparatus system according to claim 10 wherein said at least one screw conveyor further includes a hollow-shafted auger.

12. An apparatus system according to claim 5 further including at least one gas shunt tube extending from below said upper funnel portion of said retaining structure to above said upper funnel portion.

13. An apparatus system according to claim 5 further including:

(a) a solids feed system for charging said reactor vessel with feed solids; said solids feed system including:

(i) a storage receptacle;

(ii) means for delivering feed solids into said storage receptacle at ambient pressure;

(iii) means for pressurizing said storage receptacle, with liquid, to a pressure greater than ambient, and delivering feed solids from said storage receptacle into said reactor at the pressure greater than ambient; and (iv) means for venting gas from said storage receptacle.

14. An apparatus system according to claim 13 wherein said solids feed system further includes:

(a) a first valve arrangement for delivering feed solids into said storage receptacle at ambient pressure; and, (b) a second valve arrangement for delivering feed solids from said storage receptacle into said reactor at a pressure greater than ambient;

(c) wherein each of said first and second valve arrangements includes a pressure seal valve for sealing a pressure differential between said reactor vessel and said storage receptacle and a material flow valve operably position to protect said pressure seal valve from direct contact with feed solids.

* * * * *

UNITED STATES PATENT AND TRADEMARK OFFICE

CERTIFICATE OF CORRECTION

PATENT NO. : 5,354,345

DATED : October 11, 1994

INVENTOR(S) : George R. Nehls, Jr.

It is certified that error appears in the above-indentified patent and that said Letters Patent is hereby corrected as shown below:

Column 35, line 65, after the word "with", delete --the--.

Column 45, line 61, after the word "and", delete --wherein--.

Column 45, line 61, after the word "sidewall:", insert --wherein--.

Column 46, line 29, delete "at" and insert therefor --of--.

Column 47, line 11, delete "reactor arrangement" and insert therefor --apparatus system--.

Column 47, line 16, delete "outer" and insert therefor --internal--.

Column 47, line 19, after the word "sidewall", delete --defining a lower reactor region--.

Column 47, line 32, after the word "and", delete --wherein--.

Column 47, line 32, after the word "sidewall", insert --wherein--.

Column 48, line 47, delete "position" and insert therefor --positioned--.

Signed and Sealed this

Nineteenth Day of March, 1996

*Attest:*

Bruce Lehman

BRUCE LEHMAN

*Attesting Officer*

*Commissioner of Patents and Trademarks*